US007102655B2

(12) United States Patent
Toji et al.

(10) Patent No.: US 7,102,655 B2
(45) Date of Patent: Sep. 5, 2006

(54) DISPLAY METHOD AND DISPLAY EQUIPMENT

(75) Inventors: Bunpei Toji, Iizuka (JP); Hiroyuki Yoshida, Kasuya-Gun (JP); Tadanori Tezuka, Kaho-Gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 432 days.

(21) Appl. No.: 10/156,707

(22) Filed: May 28, 2002

(65) Prior Publication Data

US 2003/0222894 A1 Dec. 4, 2003

(51) Int. Cl.
*G09G 5/02* (2006.01)

(52) U.S. Cl. ..... 345/694; 345/600; 345/591

(58) Field of Classification Search ..... 345/136, 345/501, 694, 20, 63, 77, 634, 582, 423, 345/600, 591; 382/758, 46, 258, 274; 395/164; 348/207.1, 272

See application file for complete search history.

(56) References Cited

U.S. PATENT DOCUMENTS 4,720,745 A 1/1988 DeForest et al.
4,725,828 A 2/1988 Cowlishaw
5,164,825 A 11/1992 Kobayashi et al.
5,334,996 A 8/1994 Tanigaki et al.
5,369,735 A * 11/1994 Thier et al. ..... 345/423
5,384,912 A * 1/1995 Ogrinc et al. ..... 345/501
5,404,447 A 4/1995 Drako et al.
5,410,644 A * 4/1995 Thier et al. ..... 345/582
5,432,890 A 7/1995 Watanabe
5,450,208 A 9/1995 Murata
5,543,819 A 8/1996 Farwell et al.
5,623,593 A 4/1997 Spells, III
5,633,654 A 5/1997 Kennedy et al.
5,748,178 A 5/1998 Drewry
5,768,490 A 6/1998 Hersch et al.
5,821,913 A * 10/1998 Mamiya ..... 345/88
5,852,443 A 12/1998 Kenworthy
5,852,673 A 12/1998 Young (Continued)

FOREIGN PATENT DOCUMENTS

EP 0 710 925 A2 5/1996

(Continued)

OTHER PUBLICATIONS

"Sub-Pixel Font Rendering Technology", prepared by Gibson Research Corporation, Laguna Hills, CA, U.S.A.—downloaded from "http://grc.com" on Jan. 21, 2003. (9 pages).

(Continued)

*Primary Examiner*—Bipin Shalwala
*Assistant Examiner*—Prabodh Dharia
(74) *Attorney, Agent, or Firm*—Darby & Darby

(57) ABSTRACT

A per sub-pixel luminance information-generating unit enters per-pixel luminance information, and generates respective pieces of luminance information on target pixel-forming three sub-pixels using luminance information on the target pixel and an adjacent pixel. A per sub-pixel chroma information-generating unit enters per-pixel chroma information, and generates respective pieces of chroma information on the target pixel-forming sub-pixels using chroma information on the target pixel and an adjacent pixel. The target pixel and the pixel adjacent to the target pixel are used to generate respective pieces of the luminance information on the target pixel-forming three sub-pixels. Since the pixels used to generate the luminance information on a per sub-pixel basis are the same ones used to generate the luminance information, the occurrence of color irregularities is inhibited between an original image and a multi-value image displayed on a per sub-pixel basis.

10 Claims, 27 Drawing Sheets

U.S. PATENT DOCUMENTS

| | | | | |
|---|---|---|---|---|
| 5,910,805 | A | 6/1999 | Hickey et al. | |
| 5,949,433 | A * | 9/1999 | Klotz | 345/634 |
| 6,008,820 | A | 12/1999 | Chauvin et al. | |
| 6,181,353 | B1 | 1/2001 | Kurisu | |
| 6,188,385 | B1 | 2/2001 | Hill et al. | |
| 6,219,011 | B1 | 4/2001 | Aloni et al. | |
| 6,219,025 | B1 | 4/2001 | Hill et al. | |
| 6,225,973 | B1 | 5/2001 | Hill et al. | |
| 6,236,390 | B1 | 5/2001 | Hitchcock | |
| 6,239,783 | B1 | 5/2001 | Hill et al. | |
| 6,239,789 | B1 | 5/2001 | Sekizawa et al. | |
| 6,243,055 | B1 | 6/2001 | Fergason | |
| 6,243,070 | B1 | 6/2001 | Hill et al. | |
| 6,278,434 | B1 | 8/2001 | Hill et al. | |
| 6,288,703 | B1 | 9/2001 | Berman et al. | |
| 6,299,930 | B1 | 10/2001 | Marotta et al. | |
| 6,342,896 | B1 | 1/2002 | Shetter et al. | |
| 6,356,278 | B1 | 3/2002 | Stamm et al. | |
| 6,360,023 | B1 | 3/2002 | Betrisey et al. | |
| 6,377,273 | B1 | 4/2002 | Lee et al. | |
| 6,384,839 | B1 | 5/2002 | Paul | |
| 6,396,505 | B1 | 5/2002 | Lui et al. | |
| 6,429,875 | B1 * | 8/2002 | Pettigrew et al. | 345/591 |
| 6,509,904 | B1 | 1/2003 | Lam | |
| 6,532,041 | B1 | 3/2003 | Monta et al. | |
| 6,542,161 | B1 | 4/2003 | Koyama et al. | |
| 6,563,502 | B1 | 5/2003 | Dowling et al. | |
| 6,608,632 | B1 | 8/2003 | Daly et al. | |
| 6,681,053 | B1 * | 1/2004 | Zhu | 382/258 |
| 6,750,875 | B1 | 6/2004 | Keely | |
| 6,756,992 | B1 | 6/2004 | Toji et al. | |
| 6,775,420 | B1 | 8/2004 | Daly | |
| 6,879,731 | B1 * | 4/2005 | Kang et al. | 382/274 |
| 2004/0080639 | A1 * | 4/2004 | Ishiga | 348/272 |
| 2005/0083344 | A1 * | 4/2005 | Higgins | 345/600 |
| 2005/0088550 | A1 * | 4/2005 | Mitsunaga et al. | 348/272 |

FOREIGN PATENT DOCUMENTS

| | | | |
|---|---|---|---|
| EP | 1 158 485 | A2 | 12/2001 |
| JP | 6-30308 | A | 2/1994 |
| JP | 08/166778 | A1 | 6/1996 |
| JP | 2000-69488 | A | 3/2000 |
| JP | 2000-287219 | A | 10/2000 |
| JP | 2002-099239 | A1 | 4/2002 |
| WO | WO-00/21066 | A1 | 4/2000 |
| WO | WO-00/21067 | A1 | 4/2000 |
| WO | WO-00/21068 | A1 | 4/2000 |
| WO | WO-00/21070 | A1 | 4/2000 |
| WO | WO-00/42564 | A1 | 7/2000 |
| WO | WO-00/57305 | A1 | 9/2000 |
| WO | WO-01/09824 | | 2/2001 |
| WO | WO-01/09873 | | 2/2001 |

OTHER PUBLICATIONS

Markoff, John, "Microsoft's Cleartype Sets Off Debate on Originality", New York Times Online, Dec. 7, 1998, pp. 1-4.

* cited by examiner

Fig. 6

| pixel 0 | target pixel 1 | pixel 2 |
|---|---|---|
| Y0<br>Cb0<br>Cr0 | Y1<br>Cb1<br>Cr1 | Y2<br>Cb2<br>Cr2 |

| three-times magnified patterns of target pixel 1 | luminance on three sub-pixels that form the target pixel 1 | chroma on three sub-pixels that form the target pixel 1 |
|---|---|---|
| 000 | Y1、Y1、Y1 | Cb1、Cb1、Cb1<br>Cr1、Cr1、Cr1 |
| 111 | Y1、Y1、Y1 | Cb1、Cb1、Cb1<br>Cr1、Cr1、Cr1 |
| 110 | Y1、Y1、Y2 | Cb1、Cb1、Cb2<br>Cr1、Cr1、Cr2 |
| 011 | Y0、Y1、Y1 | Cb0、Cb1、Cb1<br>Cr0、Cr1、Cr1 |
| 100 | Y0、Y1、Y1 | Cb0、Cb1、Cb1<br>Cr0、Cr1、Cr1 |
| 001 | Y1、Y1、Y2 | Cb1、Cb1、Cb2<br>Cr1、Cr1、Cr2 |
| 010 | Y0、Y1、Y2 | Cb0、Cb1、Cb2<br>Cr0、Cr1、Cr2 |
| 101 | Y0、Y1、Y2 | Cb0、Cb1、Cb2<br>Cr0、Cr1、Cr2 |

Fig. 8

| pixel 0 | target pixel 1 | pixel 2 |
|---|---|---|
| Y0<br>Cb0<br>Cr0 | Y1<br>Cb1<br>Cr1 | Y2<br>Cb2<br>Cr2 |

| three-times magnified patterns of target pixel 1 | luminance on three sub-pixels that form the target pixel 1 | chroma on three sub-pixels that form the target pixel 1 |
|---|---|---|
| 000 | Y1、Y1、Y1 | Cb1、Cb1、Cb1<br>Cr1、Cr1、Cr1 |
| 111 | Y1、Y1、Y1 | Cb1、Cb1、Cb1<br>Cr1、Cr1、Cr1 |
| 110 | Y1、Y1、Y" | Cb1、Cb1、Cb"<br>Cr1、Cr1、Cr" |
| 011 | Y'、Y1、Y1 | Cb'、Cb1、Cb1<br>Cr'、Cr1、Cr1 |
| 100 | Y'、Y1、Y1 | Cb'、Cb1、Cb1<br>Cr'、Cr1、Cr1 |
| 001 | Y1、Y1、Y" | Cb1、Cb1、Cb"<br>Cr1、Cr1、Cr" |
| 010 | Y'、Y1、Y" | Cb'、Cb1、Cb"<br>Cr'、Cr1、Cr" |
| 101 | Y'、Y1、Y" | Cb'、Cb1、Cb"<br>Cr'、Cr1、Cr" |

Y' = 0.5×Y0 + 0.5×Y1  Cb' = 0.5×Cb0 + 0.5×Cb1
Y" = 0.5×Y1 + 0.5×Y2  Cb" = 0.5×Cb1 + 0.5×Cb2
Cr' = 0.5×Cr0 + 0.5×Cr1
Cr" = 0.5×Cr1 + 0.5×Cr2

Fig. 9

| | | |
|---|---|---|
| pixel 11<br>Y11<br>Cb11<br>Cr11 | pixel 21<br>Y21<br>Cb21<br>Cr21 | pixel 31<br>Y31<br>Cb31<br>Cr31 |
| pixel 12<br>Y12<br>Cb12<br>Cr12 | target pixel 22<br>Y22<br>Cb22<br>Cr22 | pixel 32<br>Y32<br>Cb32<br>Cr32 |
| pixel 13<br>Y13<br>Cb13<br>Cr13 | pixel 23<br>Y23<br>Cb23<br>Cr23 | pixel 33<br>Y33<br>Cb33<br>Cr33 |

| three-times magnified patterns of target pixel 22 | luminance on three sub-pixels that form the target pixel 22 | chroma on three sub-pixels that form the target pixel 22 |
|---|---|---|
| 000 | Y1、Y1、Y1 | Cb1、Cb1、Cb1<br>Cr1、Cr1、Cr1 |
| 111 | Y1、Y1、Y1 | Cb1、Cb1、Cb1<br>Cr1、Cr1、Cr1 |
| 110 | Y1、Y1、Y" | Cb1、Cb1、Cb"<br>Cr1、Cr1、Cr" |
| 011 | Y'、Y1、Y1 | Cb'、Cb1、Cb1<br>Cr'、Cr1、Cr1 |
| 100 | Y'、Y1、Y1 | Cb'、Cb1、Cb1<br>Cr'、Cr1、Cr1 |
| 001 | Y1、Y1、Y" | Cb1、Cb1、Cb"<br>Cr1、Cr1、Cr" |
| 010 | Y'、Y1、Y" | Cb'、Cb1、Cb"<br>Cr'、Cr1、Cr" |
| 101 | Y'、Y1、Y" | Cb'、Cb1、Cb"<br>Cr'、Cr1、Cr" |

$$Y' = 0.3 \times Y21 + 0.3 \times Y23 + 0.4 \times Y12$$
$$Y'' = 0.3 \times Y21 + 0.3 \times Y23 + 0.4 \times Y32$$
$$Cb' = 0.3 \times Cb21 + 0.3 \times Cb23 + 0.4 \times Cb12$$
$$Cb'' = 0.3 \times Cb21 + 0.3 \times Cb23 + 0.4 \times Cb32$$
$$Cr' = 0.3 \times Cr21 + 0.3 \times Cr23 + 0.4 \times Cr21$$
$$Cr'' = 0.3 \times Cr21 + 0.3 \times Cr23 + 0.4 \times Cr32$$
$$Y1 = Y22、Cb1 = Cb22、Cr1 = Cr22$$

Fig. 10

$$YX = \frac{m1 \times A1 + m2 \times A2 + \cdots + mn \times An}{m1 + m2 + \cdots + mn}$$

$$CbX = \frac{m1 \times B1 + m2 \times B2 + \cdots + mn \times Bn}{m1 + m2 + \cdots + mn}$$

$$CrX = \frac{m1 \times C1 + m2 \times C2 + \cdots + mn \times Cn}{m1 + m2 + \cdots + mn}$$

YX : luminance (Y) for each sub-pixel
CbX : chroma (Cb) for each sub-pixel
CrX : chroma (Cr) for each sub-pixel
A1～An : luminance (Y) on the pixels for use
B1～Bn : chroma (Cb) on the pixels for use
C1～Cn : chroma (Cr) on the pixels for use
n : the number of pixels for use

| | |
|---|---|
| 000000000 | 000 |
| 011001001 | 001 |
| 111111111 | 111 |

Fig. 18(a)

| | | |
|---|---|---|
| (-1, -1) | (0, -1) | (1, -1) |
| (-1, 0) | (0, 0) | (1, 0) |
| (-1, 1) | (0, 1) | (1, 1) |

* don't care

Fig. 18(b)

| | | |
|---|---|---|
| * | * | * |
| ■ | ■ | ■ |
| * | * | * |

```
if(x(-1,0)=1 and x(1,0)=1 and x(0,0)=1) then
        result := '111';
```

Fig. 18(c)

| | | |
|---|---|---|
| * | * | * |
| | | |
| * | * | * |

```
if(x(-1,0)=0 and x(1,0)=0 and x(0,0)=0) then
        result := '000';
```

Fig. 18(d)

| | | |
|---|---|---|
| * | ■ | * |
| * | ■ | * |
| * | ■ | * |

```
if(x(0,-1)=1 and x(0,1)=1 and x(0,0)=1) then
        result := '111';
```

Fig. 18(e)

| | | |
|---|---|---|
| * | | * |
| * | | * |
| * | | * |

```
if(x(0,-1)=0 and x(0,1)=0 and x(0,0)=0) then
        result := '000';
```

Fig. 18(f)

| | | |
|---|---|---|
| ■ | | |
| * | ■ | |
| * | ■ | |

```
if(x(-1,-1)=1 and x(0,1)=1 and x(0,0)=1
   and x(0,-1)=0 and x(1,-1)=0 and x(1,0)=0
   and x(1,1)=0) then
        result := '110';
```

Fig. 18(g)

| | | |
|---|---|---|
| | ■ | ■ |
| * | | ■ |
| * | | ■ |

```
if(x(-1,-1)=0 and x(0,1)=0 and x(0,0)=0
   and x(0,-1)=1 and x(1,-1)=1 and x(1,0)=1
   and x(1,1)=1) then
        result := '001';
```

⋮

| | | | | |
|---|---|---|---|---|
| 1/9 | 2/9 | 3/9 | 2/9 | 1/9 |

target sub-pixel

DISPLAY METHOD AND DISPLAY EQUIPMENT

BACKGROUND OF THE INVENTION

1. Field of the Invention

This invention relates to a method for displaying an image on a display device having light-emitting elements with three primary colors (RGB) aligned with each other, and display equipment including the display device.

2. Description of the Related Art

Display equipment that employs various types of display devices have been in customary use. One known type of display equipment heretofore includes a display device such as a color LCD and a color plasma display, in which three light-emitting elements for illuminating three primary colors (RGB) are aligned in certain sequence to form a pixel. A plurality of pixels are aligned in series in a first direction, thereby forming a line. A plurality of lines are aligned in a second direction perpendicular to the first direction, thereby forming a display screen on the display device.

A large number of display devices have display screens reduced in size to a degree that they fail to provide a sufficiently fine display. This problem is commonly seen in the display devices disposed in, e.g., a cellular phone, a mobile computer. In such display devices, small characters and photographs, or complicated pictures, are often smeared and rendered obscure in sharpness.

In order to provide improved display sharpness in such a small display screen, a reference entitled "Sub-Pixel Font-Rendering Technology" is open to the public on the Internet. The reference discloses per sub-pixel display based on a pixel formed by three light-emitting elements (RGB). The present Inventors downloaded the reference on Jun. 19, 2000 from a web site (http://grc.com/) or a subordinate thereof.

The above technology is now described with reference to FIGS. 28 to 32. In the following description, an alphabetic character "A" is used as an example of a displayed image.

FIG. 28 is a simulated illustration, showing a line that includes a chain of pixels, each of which consists of the three light-emitting elements. A horizontal direction, or a direction in which the light-emitting elements are aligned with each other, is called a first direction. A vertical direction, perpendicular to the first direction, is referred to as a second direction.

In the prior art as well as the present invention, the light-emitting elements are not limited to alignment in the order of R, G, and B, but may be arranged serially in any other alphabetical sequence.

A plurality of the pixels, each of which is formed by the three light-emitting elements, is arranged in a row in the first direction to form a line. A plurality of such lines are aligned with each other in the second direction, thereby providing a display screen.

The sub-pixel technology as discussed above addresses an original image as illustrated in, e.g., FIG. 29. In this example, the character "A" is displayed over a display screen area that consists of seven pixels-by-seven pixels in the horizontal and vertical (first and second) directions, respectively. Meanwhile, a font having a resolution as much as three times greater than that of the previous character is provided as illustrated in FIG. 30 in order to provide a per sub-pixel display. In FIG. 30, assuming that each of the light-emitting elements (RGB) is viewed as a single pixel, the character "A" is displayed over a display screen area that consists of twenty-one pixels (=7*3 pixels) horizontally by seven pixels vertically.

As illustrated in FIG. 31, a color is determined for each of the pixels of FIG. 29, but not the pixels in FIG. 30. However, color irregularities occur when the determined colors are displayed without being processed. The determined colors must be filtered using factors as shown in FIG. 32(*a*) to avoid the color irregularities. As illustrated in FIG. 32(*a*), the factors are correlated with luminance, in which a central target sub-pixel is multiplied by, e.g., a factor of 3/9. Contiguously adjacent sub-pixels next to the central sub-pixel ae multiplied by a factor of 2/9. Sub-pixels next to the contiguously adjacent sub-pixels are multiplied by a factor of 1/9, thereby adjusting the luminance of each of the sub-pixels.

Apart from the above, anti-aliasing has been practiced in order to provide improved image visibility over a small display screen area. However, a drawback to anti-aliasing is that the entire image is rendered obscure in sharpness in order to alleviate jaggies, resulting in proportionally reduced image quality.

In view of such shortcomings, the use of the sub-pixel technology as discussed above provides better image visibility than anti-aliasing.

OBJECTS AND SUMMARY OF INVENTION

The sub-pixel technology deals with black-while binary data, not multi-value data or rather color and grayscale image data.

An object of the present invention is to provide improved display method and display equipment for displaying an image on a per sub-pixel basis according to pixel-by-pixel-based multi-value image data, in which the occurrence of color irregularities between a displayed image and an original image is reduced.

A display method according to a first aspect of the present invention includes the steps of aligning three light-emitting elements with each other in a certain sequence to form a pixel, the three light-emitting elements illuminating three primary colors (RGB), aligning a plurality of the pixels in series in a first direction to form a line, aligning a plurality of the lines parallel to each other in a second direction perpendicular to the first direction, thereby forming a display screen on a display device, and displaying an image on the display device.

The display method comprises the steps of: entering per-pixel multi-value image data and then separating the entered image data into per-pixel luminance information and per-pixel chroma information; entering the per-pixel luminance information and then generating respective pieces of luminance information on target pixel-forming three sub-pixels using luminance information on a pixel adjacent to a target pixel and luminance information on the target pixel; entering the per-pixel chroma information and then generating respective pieces of chroma information on the target pixel-forming three sub-pixels using chroma information on the pixel adjacent to the target pixel and chroma information on the target pixel, the target pixel and the pixel adjacent to the target pixel are used to generate the respective pieces of luminance information on the target pixel-forming three sub-pixels; and, allocating RGB values of the pixel-forming three sub-pixels to light-emitting elements that form each of the pixels, the RGB values being determined from the luminance information and chroma information on the target pixel-forming three sub-pixels, thereby displaying an image on the display device.

Display equipment according to a second aspect of the present invention includes a display device, a luminance/ chroma-separating means, a per sub-pixel luminance information-generating unit, a per sub-pixel chroma information-generating unit, and a display control unit.

The display device has three light-emitting elements aligned with each other in certain sequence to form a pixel, the three light-emitting elements illuminating three primary colors (RGB), a plurality of the pixels are aligned in series in a first direction to form a line, and a plurality of the lines are aligned with each other in a second direction perpendicular to the first direction, thereby forming a display screen on the display device.

The luminance/chroma-separating unit enters pixel-by-pixel-based multi-value image data, and then separates the multi-value image data into per-pixel luminance information and per-pixel chroma information.

The per sub-pixel luminance information-generating unit enters the per-pixel luminance information, and then generates respective pieces of luminance information on target pixel-forming three sub-pixels using luminance information on a pixel adjacent to a target pixel and luminance information on the target pixel.

The per sub-pixel chroma information generating unit enters the per-pixel chroma information, and then generates respective pieces of chroma information on the target pixel-forming three sub-pixels using chroma information on the pixel adjacent to the target pixel and chroma information on the target pixel, the target pixel and the pixel adjacent to the target pixel are used to generate the respective pieces of the luminance information on the target pixel-forming three sub-pixels.

The display control unit allocates RGB values of the pixel-forming three sub-pixels to the light-emitting elements that form each of the pixels, the RGB values are determined on the basis of the luminance information and chroma information on the target pixel-forming three sub-pixels, thereby displaying an image on the display device.

In the display method according to the first aspect of the present invention as well as the display equipment according to the second aspect thereof as described above, the pixels used to generate the chroma information for each sub-pixel are the same ones used to produce the luminance information on a per sub-pixel basis. As a result, the occurrence of color irregularities are inhibited between a multi-value image displayed on the display device on a per sub-pixel basis and the multi-value image (original image) entered on a pixel-by-pixel basis.

A display method according to a third aspect of the present invention includes the steps of aligning three light-emitting elements with each other in certain sequence to form a pixel, the three light-emitting elements illustrating three primary colors (RGB), aligning a plurality of the pixels in series in a first direction to form a line, aligning a plurality of the lines with each other in a second direction perpendicular to the first direction, thereby forming a display screen on a display device, and displaying an image on the display device.

The display method comprises the steps of: entering per-pixel multi-value image data and then separating the entered image data into per-pixel luminance information and per-pixel chroma information; entering the per-pixel luminance information and then generating respective pieces of luminance information on target pixel-forning three sub-pixels using luminance information on a pixel adjacent to a target pixel and luminance information on the target pixel; entering the per-pixel chroma information and then producing corrected chroma information on the target pixel using chroma information on the pixel adjacent to the target pixel and chroma information on the target pixel, the target pixel and the pixel adjacent to the target pixel are used to produce the respective pieces of luminance information on the target pixel-forning three sub-pixels; and, allocating RGB values of the pixel-forming three sub-pixels to light-emitting elements that form each of the pixels, the RGB values are determined on the basis of the corrected chroma information on the target pixel and the respective pieces of luminance information on the target pixel-forming three sub-pixels, thereby displaying an image on the display device.

Display equipment according to a fourth aspect of the present invention includes a display device, a luminance/chroma-separating unit, a per sub-pixel luminance information-generating unit, a chroma information-correcting unit, and a display control unit.

The display device has three light-emitting elements aligned with each other in certain sequence to form a pixel, the three light-emitting elements illuminating three primary colors (RGB), arranging a plurality of the pixels in series in a first direction to form a line, and a plurality of the lines are aligned with each other in a second direction perpendicular to the first direction, thereby forming a display screen on the display device.

The luminance/chroma-separating unit enters per-pixel multi-value image data, and then separates the entered image data into per-pixel luminance information and per-pixel chroma information.

The per sub-pixel luminance information-generating unit enters the per-pixel luminance information, and then generates respective pieces of luminance information on target pixel-forming three sub-pixels using luminance information on a pixel adjacent to a target pixel and luminance information on the target pixel.

The chroma information-correcting unit enters the per-pixel chroma information, and then creates corrected chroma information on the target pixel using chroma information on the pixel adjacent to the target pixel and chroma information on the target pixel, the target pixel and the pixel adjacent to the target pixel are used to generate the respective pieces of the luminance information on the target pixel-forming three sub-pixels.

The display control unit allocates RGB values of the pixel-forming three sub-pixels to the three light-emitting elements that form each of the pixels, the RGB values are determined on the basis of the corrected chroma information on the target pixel and the respective pieces of luminance information on the target pixel-forming three sub-pixels, thereby displaying an image on the display device.

In the display method according to the third aspect of the present invention as well as the display equipment according to the fourth aspect thereof as discussed above, the pixels used to generate the luminance information on a per sub-pixel basis are used to produce the corrected chroma information on the target pixel. As a result, the occurrence of color irregularities is inhibited between a multi-value image displayed on the display device on a per sub-pixel basis and the multi-value image (original image) entered on a pixel-by-pixel basis.

In addition, in the display method according to the third aspect of the present invention as well as the display equipment according to the fourth aspect thereof as discussed above, the resulting corrected chroma information on the target pixel is a piece of chroma information on a pixel-by-pixel basis. The amount of data is reduced to one-third of the chroma information produced for each sub-pixel. As a result, the corrected chroma information can be stored in a limited storage area.

A display method according to a fifth aspect of the present invention includes the steps of aligning three light-emitting elements with each other in certain sequence to form a pixel, the three light-emitting elements illuminating three primary colors (RGB), aligning a plurality of the pixels in series in a first direction to form a line, aligning a plurality of the lines with each other in a second direction perpendicular to the first direction, thereby forming a display screen on a display device, and displaying an image on the display device.

The display method comprises the steps of: entering per-pixel multi-value image data and then separating the entered image data into per-pixel luminance information and per-pixel chroma information; entering the per-pixel luminance information and then mechanically generating respective pieces of luminance information on two sub-pixels of target pixel-forming three sub-pixels except for a central sub-pixel of the three sub-pixels using luminance information on a target pixel and respective pieces of luminance information on contiguously adjacent pixels next to the target pixel, while producing luminance information on the central sub-pixel by reproducing the luminance information on the target pixel onto the central sub-pixel; entering the per-pixel chroma information and then mechanically generating respective pieces of chroma information on the two sub-pixels of the target pixel-forming three sub pixels except for the central sub-pixel thereof using chroma information on the target pixel and respective pieces of chroma information on the contiguously adjacent pixels next to the target pixel, the target pixel and the contiguously adjacent pixels next to the target pixel are used to generate the luminance information, while generating chroma information on the central sub-pixel by reproducing the chroma information on the target pixel onto the central sub-pixel; and, allocating RGB values of the pixel-forming three sub-pixels to light-emitting elements that form each of the pixels, the RGB values are determined on the basis of the respective luminance and chroma information on the target pixel-forming three sub-pixels, thereby displaying an image on the display device.

Display equipment according to a sixth aspect of the present invention includes a display device, a luminance/chroma-separating unit, a per sub-pixel luminance information-generating unit, a per sub-pixel chroma information-generating unit, and a display control unit.

The display device has three light-emitting elements aligned with each other in certain sequence to form a pixel, the three light-emitting elements illuminating three primary colors (RGB), arranging a plurality of the pixels in series in a first direction to form a line, and a plurality of the lines are aligned with each other in a second direction perpendicular to the first direction, thereby forming a display screen on the display device.

The luminance/chroma-separating unit enters per-pixel multi-value image data, and then separates the entered image data into per-pixel luminance information and per-pixel chroma information.

The per sub-pixel luminance information-generating unit enters the per-pixel luminance information, and then mechanically generates respective pieces of luminance information on two sub-pixels of target pixel-forming three sub-pixels except for a central sub-pixel of the three sub-pixels using luminance information on a target pixel and respective pieces of luminance information on contiguously adjacent pixels next to the target pixel, while producing luminance information on the central sub-pixel by reproducing the luminance information on the target pixel onto the central sub-pixel.

The per sub-pixel chroma information-generating unit enters the per-pixel chroma information, and then mechanically generates respective pieces of chroma information on the two sub-pixels of the target pixel-forming three sub-pixels except for the central pixel thereof using chroma information on the target pixel and respective pieces of chroma information on the contiguously adjacent pixels next to the target pixel, the target pixel and the contiguously adjacent pixels next thereto are used to generate the luminance information, while producing chroma information on the central sub-pixel by reproducing the chroma information on the target pixel onto the central sub-pixel.

The display control unit allocates RGB values of the pixel-forming three sub-pixels to the three light-emitting elements that forms each of the pixels, the RGB values are determined on the basis of the respective luminance and chroma information on the target pixel-forming three sub-pixels, thereby displaying an image on the display device.

In the display method according to the fifth aspect of the present invention as well as the display equipment according to the sixth aspect thereof as discussed above, the pixels used to generate the luminance information on a per sub-pixel basis are used to produce the chroma information on a per sub-pixel basis. As a result, the occurrence of color irregularities is inhibited between a multi-value image displayed on the display device on a per sub-pixel basis and the multi-value image (original image) entered on a pixel-by-pixel basis.

In addition, in the display method according to the fifth aspect of the present invention as well as the display equipment according to the sixth aspect thereof, less processing is achievable because the step of selecting a specific target pixel is eliminated, as opposed to the previously discussed aspects of the present invention in which such a specific target pixel is initially selected, and then respective pieces of luminance information on sub-pixels that form the selected target pixel are generated using luminance information on any pixel adjacent to the target pixel and luminance information on the target pixel.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 2(*b*) is an illustration, showing how luminance information is binarized using a variable threshold as an illustration.

FIG. 4(*b*) is an illustration, showing how chroma information is generated using reproduction as an illustration.

FIG. 5(*b*) is a further illustration, showing how chroma information is generated using reproduction by way of illustration.

FIG. 6 is an illustration, showing a relationship between three-times magnified patterns and luminance and chroma information generated using reproduction.

FIG. 7(*b*) is an illustration, showing how chroma information is generated using weighted means as an illustration.

FIG. 8 is an illustration, showing a relationship between three-times magnified patterns and luminance and chroma information generated using weighted means.

FIG. 9 is an illustration, showing a relationship between three-times magnified patterns and luminance and chroma information generated using other weighted means.

FIG. 10 is a descriptive illustration, showing weighted means expressions for use in determining luminance and chroma information using weighted means.

FIG. 15(*b*) is an illustration, showing a three-times magnified pattern by way of illustration in the three-times magnified pattern-generating unit.

FIG. 15(*c*) is an illustration, showing a reference pattern as an illustration in the three-times magnified pattern-generating unit.

FIG. 15(*d*) is an illustration, showing a three-times magnified pattern as an illustration in the three-times magnified pattern-generating unit.

FIG. 15(*e*) is an illustration, showing a reference pattern by way of illustration in the three-times magnified pattern-generating unit.

FIG. 15(*f*) is an illustration, showing a three-times magnified pattern by way of illustration in the three-times magnified pattern-generating unit.

FIG. 18(*a*) is an illustration, showing how a reference pattern is defined in a three-times magnified pattern-generating unit.

FIG. 18(*b*) is an illustration, showing a relationship between a reference pattern and a three-times magnified pattern in the three-times magnified pattern-generating unit.

FIG. 18(*c*) is an illustration, showing a relationship between a reference pattern and a three-times magnified pattern in the three-times magnified pattern-generating unit.

FIG. 18(*d*) is an illustration, showing a relationship between a reference pattern and a three-times magnified pattern in the three-times magnified pattern-generating unit.

FIG. 18(*e*) is an illustration, showing a relationship between a reference pattern and a three-times magnified pattern in the three-times magnified pattern-generating unit.

FIG. 18(*f*) is an illustration, showing a relationship between a reference pattern and a three-times magnified pattern in the three-times magnified pattern-generating unit.

FIG. 18(*g*) is an illustration, showing a relationship between a reference pattern and a three-times magnified pattern in the three-times magnified pattern-generating unit.

FIG. 25(*b*) is a descriptive illustration, showing how chroma information is generated using weighted means.

FIG. 26(*b*) is a descriptive illustration, showing how chroma information is generated using yet further weighted means.

FIG. 32(*b*) is an illustration, showing prior art filtering results by way of illustration.

DETAILED DESCRIPTION OF THE PREFERRED EMBODIMENTS

Embodiment 1

Figure 1:
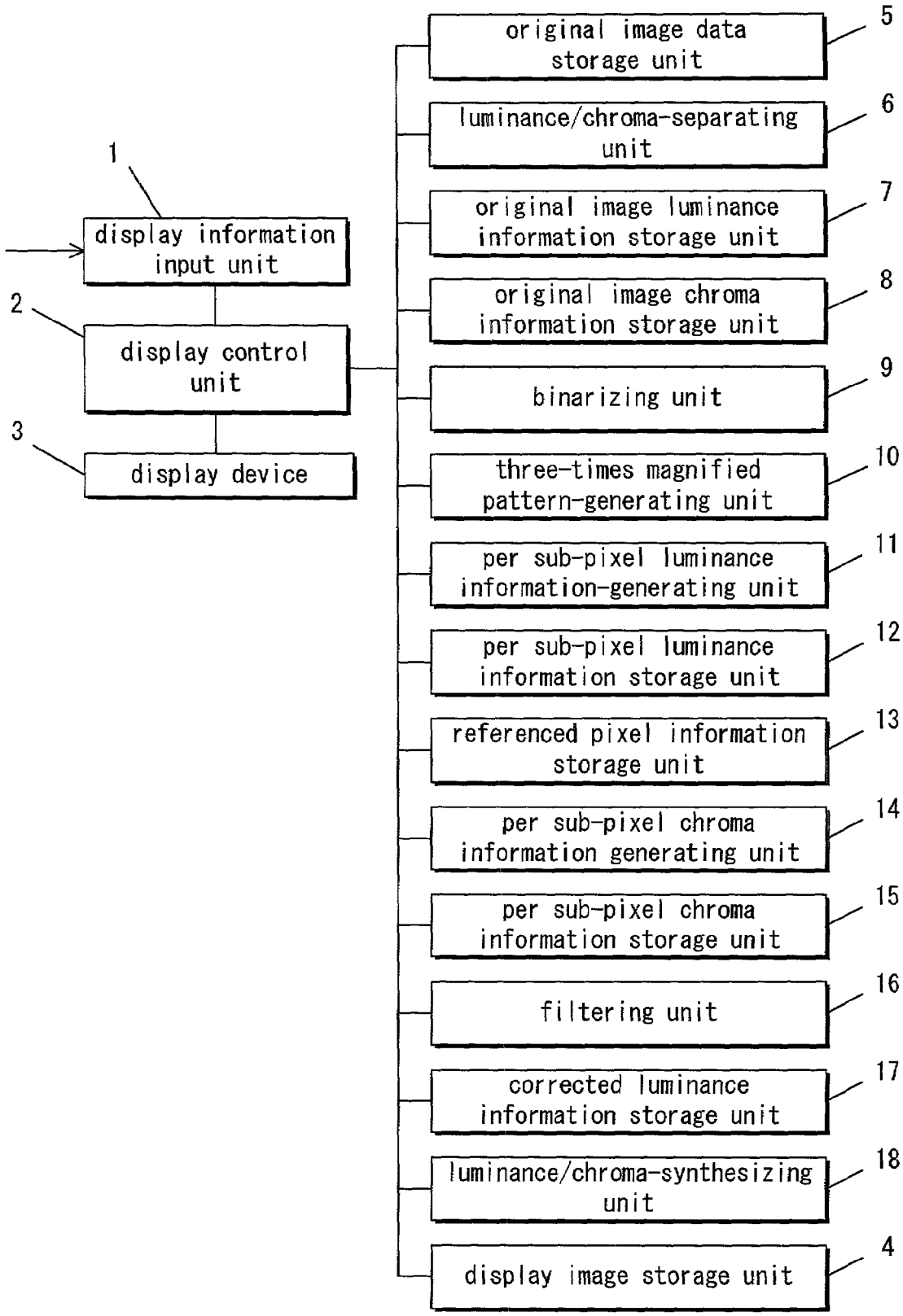
FIG. 1 is a block diagram, illustrating display equipment according to a first embodiment of the present invention.

Referring to FIG. 1, a display equipment according to a first embodiment of the invention includes a display information input unit 1, a display control unit 2, a display device 3, a display image storage unit 4, an original image data storage unit 5, a luminance/chroma-separating unit 6, an original image luminance information storage unit 7, an original image chroma information storage unit 8, a binarizing unit 9, a three-times magnified pattern-generating unit 10, a per sub-pixel luminance information-generating unit 11, a per sub-pixel luminance information storage unit 12, an referenced pixel information storage unit 13, a per sub-pixel chroma information-generating unit 14, a per sub-pixel chroma information storage unit 15, a filtering unit 16, an corrected luminance information storage unit 17, and a luminance/chroma-synthesizing unit 18.

The display information input unit I enters original image data into the original image data storage unit 5 which stores the original image data as display information.

The original image data is multi-value image data. The multi-value image data herein refers to either color image data or grayscale image data.

The display control unit 2 controls all components of FIG. 1 to display an image to be displayed on the display device 3 for each sub-pixel in accordance with a display image stored in the display image storage unit 4 (VRAM).

The display device 3 has three light-emitting elements for illuminating three primary colors (RGB) aligned with each other in certain sequence to form a pixel. A plurality of pixels are arranged in series in a first direction to form a line. A plurality of the lines are aligned with each other in a second direction perpendicular to the first direction, thereby forming a display screen on the display device 3. More specifically, the display device 3 be any one of a color LCD (liquid crystal display), a color plasma display, an organic EL (electroluminescent) display, or any other type of display now existing, or to be invented The display device 3 includes drivers for driving such light-emitting elements.

A sub-pixel is now discussed in brief In the present embodiments, the sub-pixel is an element obtained by cutting a single pixel into three equal parts in the first direction. Thus, the pixel is formed by the three light-emitting elements aligned with each other in a certain order for illuminating the three primary colors (RGB), respectively. Therefore, three sub-pixels, representative of RGB, correspond with the respective light-emitting elements (RGB).

[Conversion From RGB to YCbCr]

The luminance/chroma-separating unit 6 separates per-pixel original image data into per-pixel luminance information (Y) and per-pixel chroma information (Cb, Cr).

Assume that RGB in the original image data are valued as r, g, and b, respectively, as expressed by the following formulae: $Y=0.299*r+0.587*g+0.114*b$; $Cb=0.172*r-0.339*g+0.511*b$; and, $Cr=0.511*r-0.428*g-0.083*b$. These equations are exhibited as an illustration, and may be replaced by similar formulae.

The luminance/chroma-separating unit 6 divides the original image data between the luminance information (Y) and the chroma information (Cb, Cr) using the formulae as given above. At this time, the luminance and chroma information are given on a per-pixel basis.

The resulting luminance information (Y) and chroma information (Cb, Cr) are stored tentatively in the original image luminance and chroma information storage units 7 and 8, respectively.

[Binarization]

The luminance information is adjusted for each sub-pixel to provide smoothly displayed boundaries in a displayed image between characters/pictures and the background. Such adjustment is detailed in an appropriate section. Binarization is primarily performed to generate a three-times magnified pattern, but is used also to detect the boundaries. The three-times magnified pattern is described in detail in an appropriate section.

The binarizing unit 9 extracts respective pieces of luminance information on a target pixel and neighboring pixels about the target pixel from the original image luminance information storage unit 7. The binarizing unit 9 then binarizes the respective pieces of luminance information using a threshold, thereby producing binary data.

More specifically, a comparison of the threshold with the respective pieces of luminance information is made to determine whether or not the luminance information on each pixel is greater than the threshold, thereby binarizing the luminance information on a pixel-by-pixel basis. The binarized luminance information provides binary data that consists of white or "0" and black or "1".

The binarizing unit 9 provides a bitmap pattern by binarizing the luminance information as discussed above. The bitmap pattern consists of the target pixel and neighboring pixels thereabout.

The threshold may be either fixed or variable to binarize the luminance information. However, a fixed threshold is preferred since it requires less processing. In contrast, a variable threshold is desirable for better quality. Such a difference is now discussed in more detail.

Figure 2A:
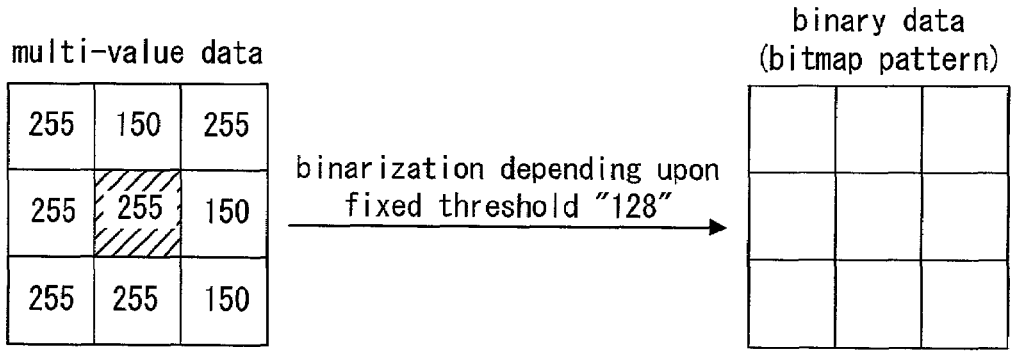
FIG. 2(*a*) is an illustration, showing how luminance information is binarized using a fixed threshold by way of illustration.
Figure 2B:
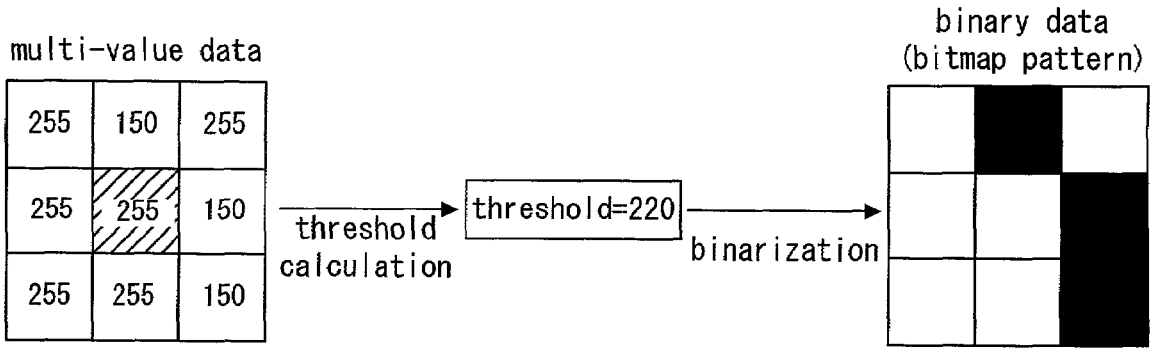

FIG. 2(*a*) is a descriptive illustration, showing how luminance information is binarized using a fixed threshold. FIG. 2(*b*) shows binarization using variable thresholds by way of illustration.

As illustrated in FIG. 2(*a*), assume that luminance information (multi-value data) on a target pixel (defined by slanted lines) and respective pieces of luminance information on surrounding pixels about the target pixel are extracted, and are then binarized using a fixed threshold of, e.g., "128".

In FIG. 2(*a*), the extracted luminance information on all of the pixels is greater than threshold 128. The binarized luminance information is converted into binary data that consists of all "0" or all whites, thereby yielding a bitmap pattern that consists of all whites "0".

Similar to FIG. 2(*a*), FIG. 2(*b*) illustrates extracted luminance information (multi-value data) that consists of three pixels-by-three pixels including a centered target pixel, all having the same values as in FIG. 2(*a*). Such luminance information is extracted for each target pixel, and is thus extracted with reference to all of the target pixels. The luminance information consisting of three pixels-by-three pixels is extracted for each of the target pixels.

When the extracted three pixels-by-three-pixels are considered as a single unit, a threshold is set for each unit. The threshold is of a variable type. The variable threshold is calculated using, e.g., "Otsu's threshold calculation method".

As illustrated in FIG. 2(*b*), a variable threshold is 220 for the extracted three pixels-by-three pixels. The luminance information consisting of three pixels-by-three pixels (multi-value data) is binarized using 220-variable threshold, thereby providing binary data. The binary data results in white or "0" for each piece of luminance information that is greater than the 220-variable threshold, but conversely results in black or "1" for the remainder. As a result, the resulting bitmap pattern as illustrated in FIG. 2(*b*) differs from that of FIG. 2(*a*).

In FIG. 2(*a*), the use of 128-fixed threshold turns different pieces of luminance information such as 255 (white) and 150 (green) into the same binary data that consists of white or "0".

In FIG. 2(*b*), the use of 220-variable threshold brings different pieces of luminance information such as 255 (white) and 150 (green) into different binary data that consist of white or "0" and black or "1", respectively.

This means that, when luminance information on, e.g., a color image is binarized, the boundaries (character edges) between characters and the background can be detected using the variable threshold, but not using the fixed threshold.

As described later, the luminance information is adjusted for each sub-pixel to smoothly display the boundaries between the character/picture and the background. Since the use of the variable threshold allows the boundaries to be detected within fine limits, more smoothly displayed boundaries are achievable than with the fixed threshold.

The use of the fixed threshold involves less processing than when the variable threshold is employed because the fixed threshold need not be determined for each set of three pixels-by-three pixels (or for each unit), that must be extracted for each target pixel.

[Generating a Three-Times Magnified Pattern]

Figure 3:
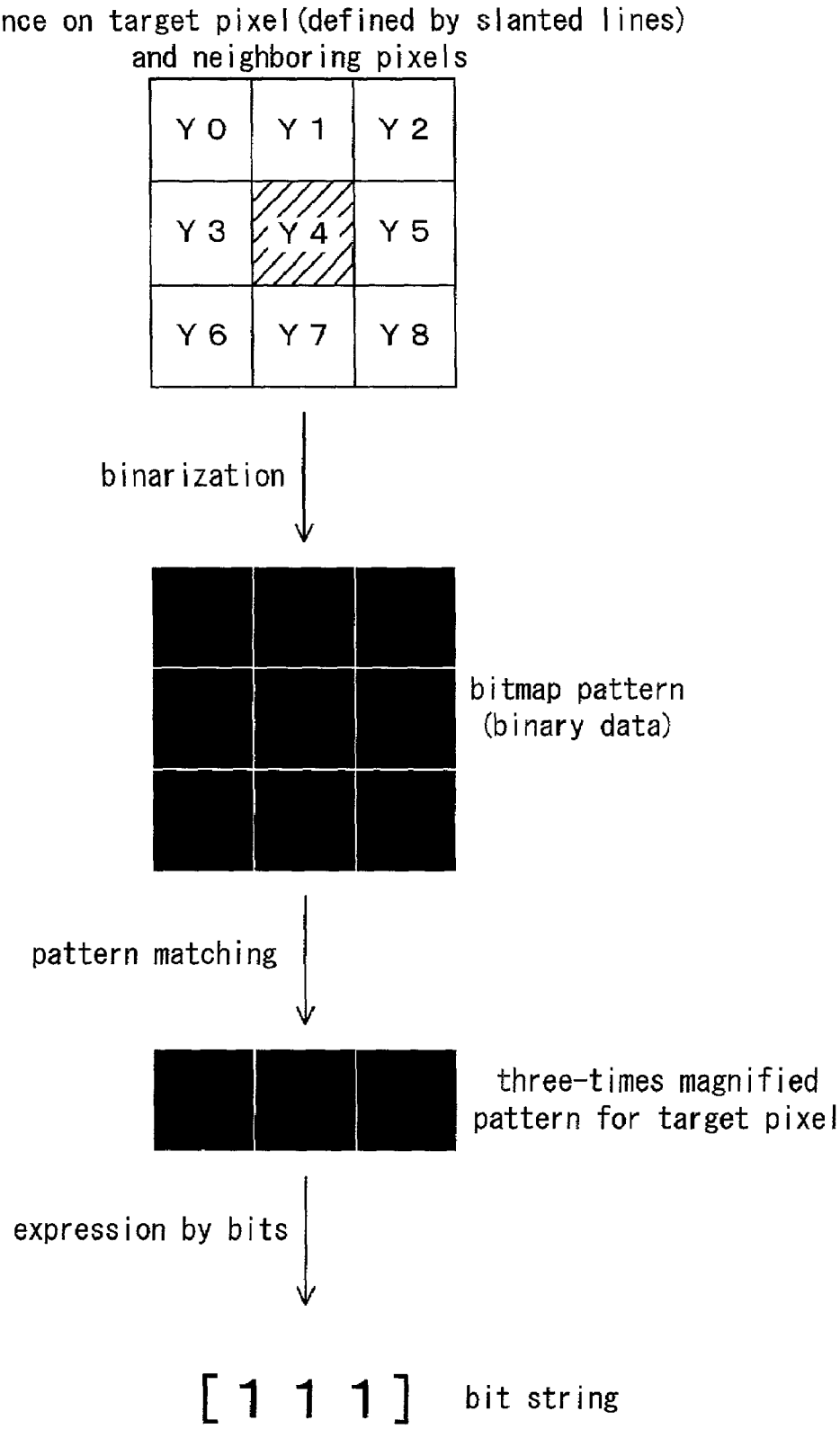
FIG. 3 is an illustration, showing a flow of processing from the step of binarizing luminance information to the step of creating a three-times magnified pattern.

Referring now to FIG. 3, the three-times magnified pattern-generating unit 10 produces a three-times magnified pattern on the basis of a bitmap pattern or binary data provided by the binarizing unit 9. The three-times magnified pattern is created using either pattern matching or logic operation, both of which will be discussed in detail in appropriate sections.

FIG. 3 shows the flow of processing from the step of binarizing luminance information to the step of creating a three-times magnified pattern from the binarized luminance information. The binarizing unit 9 extracts respective pieces of luminance information on a target pixel (defined by slanted lines) and neighboring pixels about the target pixel from the original image luminance information storage unit 7.

The binarizing unit 9 binarizes the extracted luminance information using a threshold, thereby producing binary data on the target pixel and neighboring pixel about it. In short, binarizing the luminance information brings about a bitmap pattern for the target pixel and surrounding pixels about it.

In the next step, the three-times magnified pattern-generating unit 10 creates a three-times magnified pattern for the target pixel according to the bitmap pattern or binary data given by the binarizing unit 9.

In a further step, the three-times magnified pattern-generating unit 10 creates a bit string in which the three-times magnified pattern of the target pixel is expressed by bits.

[Generating Luminance and Chroma Information on a Per Sub-Pixel Basis]

A process for generating luminance and chroma information on a per sub-pixel basis is broadly divided into two methods, i.e., a reproduction method and a weighted method. The reproduction method is described first below.

The per sub-pixel luminance information-generating unit 11 generates respective pieces of luminance information on target pixel-forming three sub-pixels by reproducing luminance information on a target pixel onto these three sub-pixels.

Alternatively, the per sub-pixel luminance information-generating unit 11 generates luminance information on a central sub-pixel of the target pixel-forming three sub-pixels. It does this by reproducing the luminance information on the target pixel onto the central sub-pixel, while generating respective pieces of luminance information on the remaining sub-pixels of the three sub-pixels at opposite ends thereof by reproducing respective pieces of luminance information on contiguously adjacent pixels next to the target pixel onto the remaining sub-pixels of the three sub-pixels according to the three-times magnified pattern produced by the three-times magnified pattern-generating unit 10.

The three-times magnified pattern of the target pixel is generated according to the bitmap pattern produced by the binarizing unit 9. The bitmap pattern may be used to decide whether or not the luminance information on the remaining sub-pixels of the three sub-pixels at both ends thereof is produced by the respective pieces of luminance information on the contiguously adjacent pixels next to the target pixel are reproduced on the remaining sub-pixels of the three sub-pixels.

When the respective pieces of luminance information on the target pixel-forming three sub-pixels are generated by the luminance information on the target pixel are reproduced on the three sub-pixels, or when the luminance information on each of the target pixel-forming three sub-pixels is generated without the use of the luminance information on any pixel next to the target pixel, then the per sub-pixel chroma information-generating unit 14 generates respective pieces of chroma information on the target pixel-forming three sub-pixels by reproducing chroma information on the target pixel onto the three sub-pixels.

When the luminance information on any one of the target pixel-forming sub-pixels is generated using the luminance information on any pixel next to the target pixel, then the per sub-pixel chroma information-generating unit 14 generates chroma information on that particular sub-pixel by reproducing chroma information on the pixel next to the target pixel onto the sub-pixel in question. Respective pieces of chroma information on the remaining sub-pixels are produced by the chroma information on the target pixel are reproduced on the remaining sub-pixels.

An illustrative example is now described.

Figure 4A:
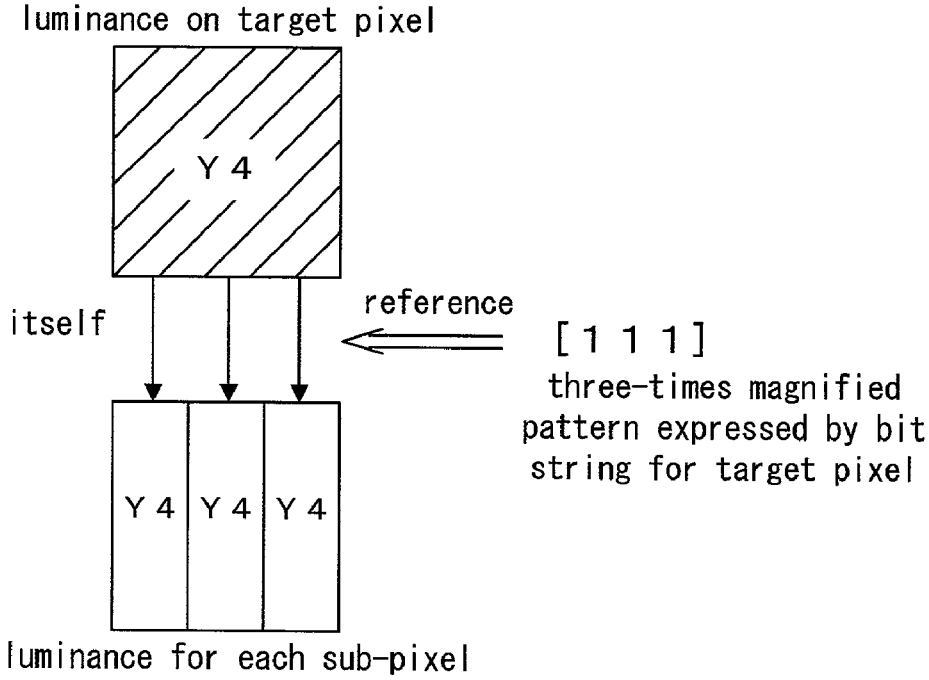
FIG. 4(*a*) is an illustration, showing how luminance information is generated using reproduction as an illustration.
Figure 4B:
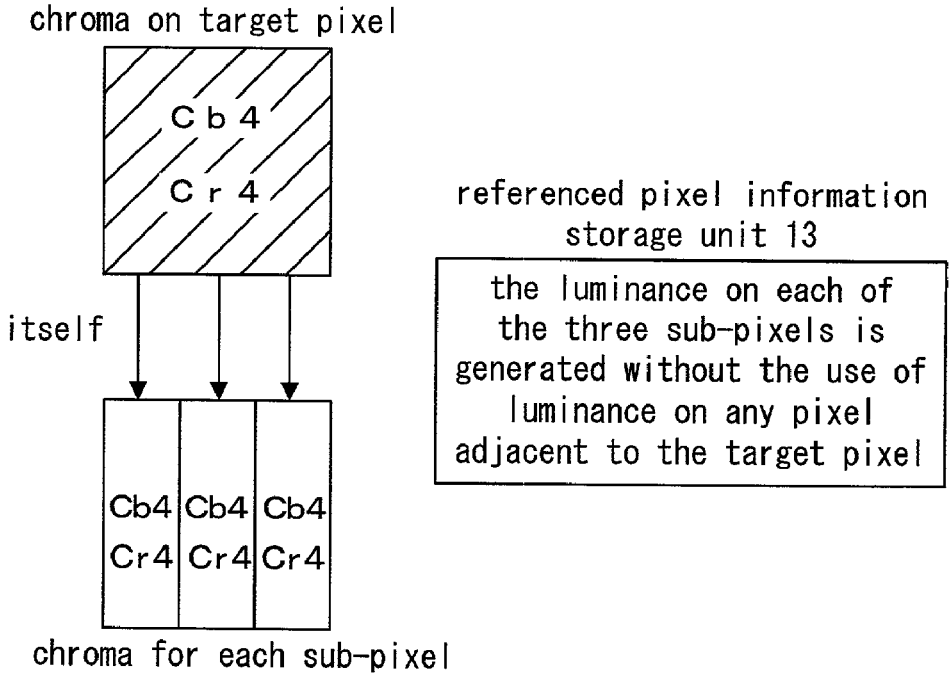

FIGS. 4(*a*) and 4(*b*) illustrate how luminance and chroma information is generated for each sub-pixel using reproduction as an illustration. FIGS. 4(*a*) and 4(*b*) illustrate examples of generating the luminance and chroma information, respectively.

As illustrated in FIG. 4(*a*), when a target pixel (defined by slanted lines) has a three-times magnified pattern expressed by bit string [111], then the per sub-pixel luminance information-generating unit 11 generates respective pieces of luminance information (Y) on a target pixel-forming three sub-pixels by reproducing luminance information Y4 on a target pixel onto the three sub-pixels.

The per sub-pixel luminance information-generating unit 11 places into the referenced pixel information storage unit 13 the luminance information on each of the three sub-pixels generated without the use of luminance information on any pixel adjacent to the target pixel.

As illustrated in FIG. 4(*b*), when the luminance information on each of the three sub-pixels is generated without the use of luminance information on any pixel adjacent to the target pixel, then the per sub-pixel chroma information-generating unit 14 generates respective pieces of chroma information (Cb, Cr) on the target pixel-forming three sub-pixels by reproducing chroma information (Cb4, Cr4) on the target pixel onto the three sub-pixels At that time, the per sub-pixel chroma information-generating unit 14 references the referenced pixel information storage unit 13, thereby ascertaining that the luminance information on all of the three sub-pixels is generated without the use of the luminance information on any pixel next to the target pixel.

In FIG. 4(*b*), two pieces of chroma information Cb4, Cr4 appear in the single target pixel. This means that the chroma information Cb4, Cr4 is present in the single target pixel. Two pieces of chroma information Cb4, Cr4 appear in the single sub-pixel. This means that the chroma information Cb4, Cr4 is present in the single sub-pixel. This feature is given throughout the present description.

Figure 5A:
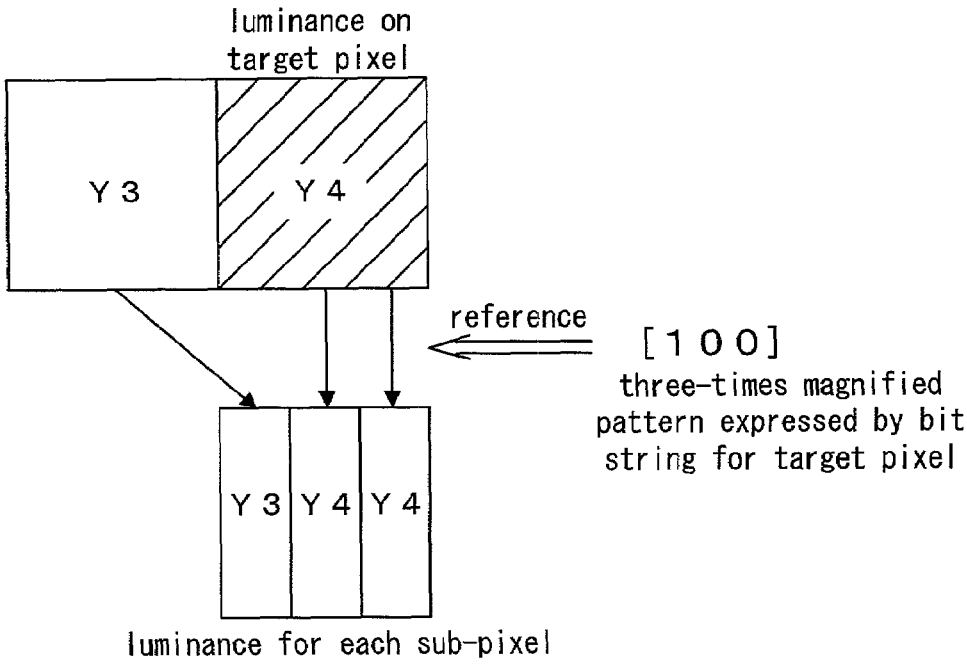
FIG. 5(*a*) is another illustration, showing how luminance information is produced by way of reproduction as another illustration.
Figure 5B:
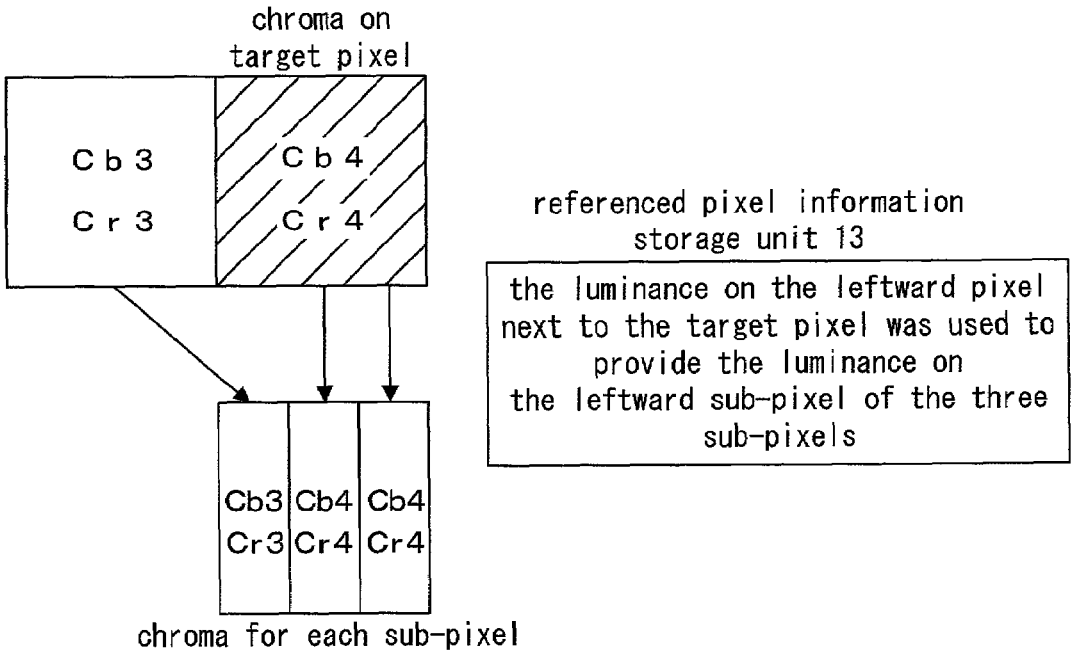

FIGS. 5(*a*) and 5(*b*) illustrate how luminance and chroma information is generated for each sub-pixel using reproduction as an illustration. FIGS. 5(*a*) and 5(*b*) illustrate examples of producing the luminance and chroma information, respectively.

As illustrated in FIG. 5(*a*), when a target pixel (defined by slanted lines) has a three-times magnified pattern expressed by bit string [100], the per sub-pixel luminance information-generating unit 11 generates respective pieces of luminance information (Y) on central and rightward sub-pixels of a target pixel-forming three sub-pixels by reproducing luminance information Y4 on a target pixel onto the central and rightward sub-pixels.

The per sub-pixel luminance information-generating unit 11 generates luminance information (Y) on a leftward sub-pixel of the three sub-pixels by reproducing luminance information Y3 on a leftward pixel next to the target pixel onto the leftward sub-pixel.

The per sub-pixel luminance information-generating unit 11 puts into the referenced pixel information storage unit 13 the following information: the luminance information on the leftward sub-pixel of the three-sub-pixels generated using the luminance information on the leftward pixel adjacent to the target pixel.

As illustrated in FIG. 5(*b*), when the luminance information on the leftward pixel next to the target pixel is used to provide the luminance information on the leftward sub-pixel of the three sub-pixels, then the per sub-pixel chroma information-generating unit 14 produces chroma information (Cb, Cr) on the leftward sub-pixel of the target pixel-forming three sub-pixels by reproducing chroma information Cb3, Cr3 on the leftward pixel adjacent to the target pixel onto the leftward sub-pixel.

The per sub-pixel chroma information-generating unit 14 generates respective pieces of chroma information (Cb, Cr) on the central and rightward sub-pixels of the target pixel-forming three sub-pixels by reproducing chroma information Cb4, Cr4 on the target pixel onto the central and rightward sub-pixels.

The per sub-pixel chroma information-generating unit 14 references the referenced pixel information storage unit 13, thereby ascertaining that the luminance information on the leftward sub-pixel of the target pixel-forming sub-pixels is generated using the luminance information on the leftward pixel next to the target pixel.

FIG. 6 illustrates a relationship between three-times magnified patterns of a target pixel and corresponding pieces of luminance and chroma information generated for each sub-pixel using reproduction.

FIG. 6 illustrates an example in which pixel 0, target pixel 1, and pixel 2 are aligned with each other in this order.

Pixel 0 has luminance information (Y) and chroma information (Cb, Cr) defined as Y0, Cb0, and Cr0, respectively. Pixel 1 has luminance information (Y) and chroma information (Cb, Cr) defined as Y1, Cb1, and Cr1, respectively. Pixel 2 has luminance information (Y) and chroma information (Cb, Cr) defined as Y2, Cb2, and Cr2, respectively.

The target pixel includes eight different types of three-times magnified patterns. In FIG. 6, the target pixel is shown having the patterns expressed by eight different types of bit strings. Respective pieces of luminance information (Y) and chroma information (Cb, Cr) on three sub-pixels that form the target pixel 1 are enumerated for each of the three-times magnified patterns.

Next, a method for generating luminance and chroma information for each sub-pixel using weighting is now described.

The per sub-pixel luminance information-generating unit 11 generates respective pieces of luminance information on target consisting of pixel-forming three sub-pixels by reproducing luminance information on a target pixel onto the three sub-pixels.

Alternatively, the per sub-pixel luminance information-generating unit 11 generates luminance information on a central sub-pixel of the target pixel-forming three sub pixels by reproducing the luminance information on the target pixel onto the central sub-pixel, while producing respective pieces of luminance information on the remaining sub-pixels of the three sub-pixels at opposite ends thereof using respective weighted means that include the luminance information on the target pixel and respective pieces of luminance information on contiguously adjacent pixels next to the target pixel according to a three-times magnified pattern provided by the three-times magnified pattern-generating unit 10.

The three-times magnified pattern is created on the basis of a bitmap pattern provided by the binarizing unit 9. The bitmap pattern may be used to decide whether or not respective pieces of luminance information on the remainders of the three sub-pixels at opposite ends thereof are generated according to the weighted means.

When the respective pieces of luminance information on the three sub-pixels are generated by the luminance information on the target pixel and reproduced on the three sub-pixels, or when the luminance information on each of the three sub-pixels is given without the use of the luminance information on any pixel next to the target pixel, then the per sub-pixel chroma information-generating unit 14 generates respective pieces of chroma information on the target pixel-forming three sub-pixels by reproducing chroma information on the target pixel onto the three sub-pixels.

When the luminance information on any one of the target pixel-forming three sub-pixels is generated using respective pieces of luminance information on the target pixel and a pixel adjacent to the target pixel, then the per sub-pixel chroma information-generating unit 14 generates chroma information on that particular sub-pixel using a weighted means that includes respective pieces of chroma information on the target pixel and the pixel next to the target pixel. Respective pieces of chroma information on the remaining sub-pixels of the three sub-pixels are produced by the chroma information on the target pixel and are reproduced on the remaining sub-pixels.

An illustrative example is now described.

Figure 7A:
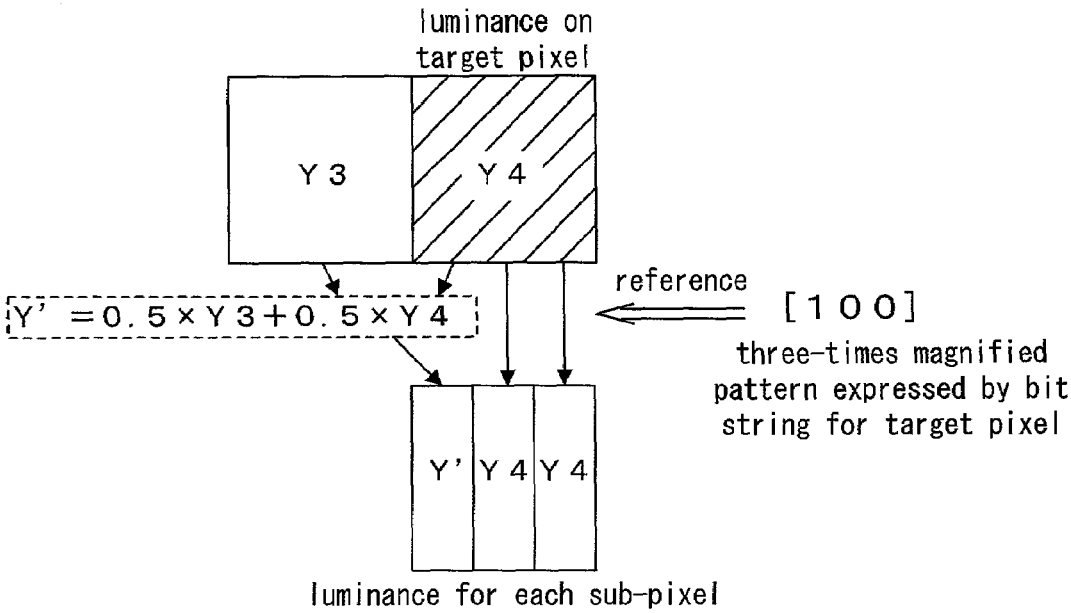
FIG. 7(*a*) is an illustration, showing how luminance information is generated using a weighted means as an illustration.
Figure 7B:
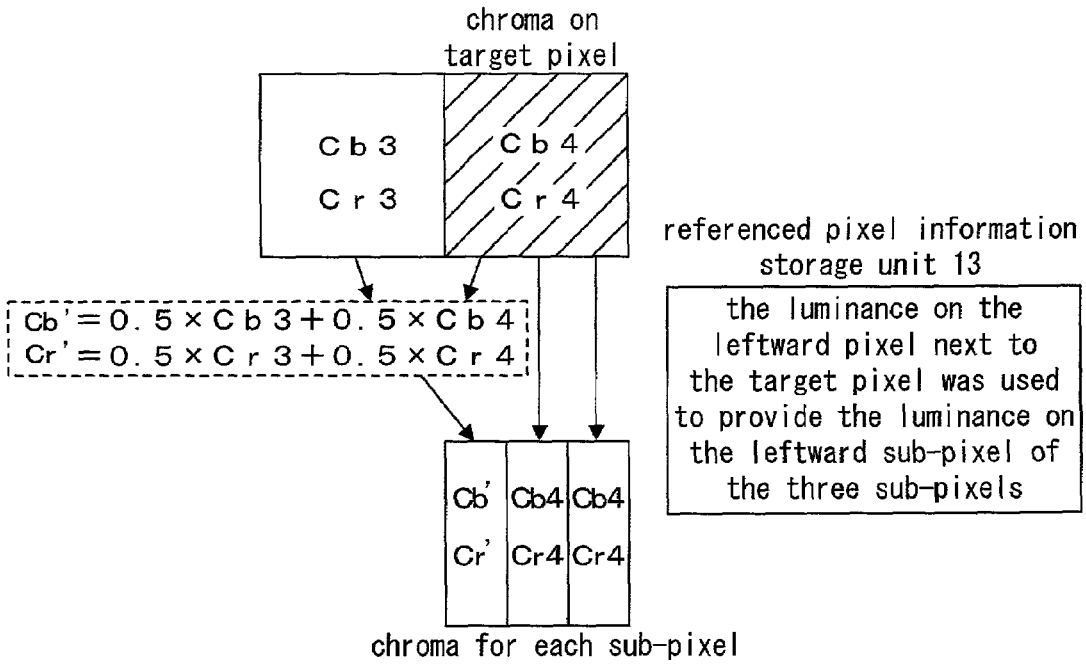

FIGS. 7(*a*) and 7(*b*) illustrate how luminance and chroma information is generated for each sub-pixel using a weighted means by way of illustration. FIGS. 7(*a*) and 7(*b*) show exemplary generation of the luminance and chroma information, respectively.

As illustrated in FIG. 7(*a*), when a target pixel (defined by slanted lines) has a three-times magnified pattern expressed by a bit string [100], then the per sub-pixel luminance information-generating unit 11 generates respective pieces of luminance information (Y) on central and rightward sub-pixels of target pixel-forming three sub-pixels by reproducing luminance information on a target pixel onto the central and rightward sub-pixels.

The per sub-pixel luminance information-generating unit 1 generates luminance information Y' on the remaining leftward sub-pixel of the three sub-pixels using a weighted means that includes luminance information Y4 on the target pixel and luminance information Y3 on a leftward pixel next to the target pixel.

More specifically, luminance information Y' on the leftward sub-pixel is created according to expression: Y'=0.5*Y3+0.5*Y4.

The per sub-pixel luminance information-generating unit 11 then places into the referenced pixel information storage unit 13 the luminance information on the leftward sub-pixel produced using the luminance information on the leftward pixel next to the target pixel.

As illustrated in FIG. 7(*b*), when the luminance information on the leftward sub-pixel of the target pixel-forming three sub-pixels is produced using the luminance information on the leftward pixel next to the target pixel, then the per sub-pixel chroma information-generating unit 14 produces chroma information Cb', Cr' on the leftward sub-pixel of the target pixel-forming three sub-pixels using weighted means that include chroma information Cb4, Cr4 on the target pixel and chroma information Cb3, Cr3 on the leftward pixel next to the target pixel, respectively.

More specifically, chroma information Cb' and Cr' on the leftward sub-pixel are produced according to expressions Cb'=0.5*Cb3+0.5*Cb4 and Cr'=0.5*Cr3+0.5*Cr4, respectively.

The per sub-pixel chroma information-generating unit 14 generates respective pieces of chroma information (Cb, Cr) on the central and rightward sub-pixels of the target pixel-forming three sub-pixels by reproducing chroma information Cb4, Cr4 on the target pixel onto the central and rightward sub-pixels.

When the target pixel has a three-times magnified pattern expressed by bit string [111], then the use of the weighted means produces the same luminance and chroma information as that of FIG. 4 for each sub-pixel.

FIG. 8 illustrates a relationship between three-times magnified patterns of a target pixel and corresponding pieces of luminance and chroma information generated for each sub-pixel using weighted means.

The illustration shows an example in which a pixel 0, target pixel 1, and pixel 2 are aligned with each other in this sequence.

The pixel 0 has luminance information (Y) and chroma information (Cb, Cr) defined as Y0, Cb0, and Cr0, respectively. The target pixel 1 has luminance information (Y) and chroma information (Cb, Cr) defined as Y1, Cb1, and Cr1, respectively. The pixel 2 has luminance information (Y) and chroma information (Cb, Cr) defined as Y2, Cb2, and Cr2, respectively.

The target pixel includes eight different types of three-times magnified patterns. In FIG. 8, the target pixel is shown having the patterns expressed by eight different types of bit strings. Respective pieces of luminance information (Y) and chroma information (Cb, Cr) on three sub-pixels that form the target pixel 1 are enumerated for each of the three-times magnified patterns.

As discussed in connection with FIGS. 7(*a*)/7(*b*) and 8, the luminance information is defined on a per sub-pixel basis by the weighted means that include luminance information on the target pixel and luminance information on either rightward or leftward pixel next to the target pixel. The chroma information is defined on a per sub-pixel basis by the weighted means that include chroma information on the target pixel and chroma information on either the rightward or leftward pixel next to the target pixel. The weighted means is not limited to a single direction such as a rightward or leftward direction, but includes other examples, which are now described.

FIG. 9 illustrates a relationship between three-times magnified patterns of a target pixel and corresponding pieces of luminance and chroma information generated for each sub-pixel using other weighted means.

Pixels 11, 21, 31 are aligned in a first direction with each other in this order, thereby forming one line. A pixel 12, a target pixel 22, and a pixel 32 are disposed in series in the first direction in this order, thereby forming another line. Pixels 13, 23, 33 are serially arranged in the first direction in this order, thereby forming yet another line. As a result, these three lines are aligned with each other in a second direction.

The pixel 11 has luminance information (Y) and chroma information (Cb, Cr) defined as Y11, Cb11, and Cr11, respectively. The pixel 21 has luminance information (Y) and chroma information (Cb, Cr) defined as Y21, Cb21, and Cr21, respectively. The pixel 31 has luminance information (Y) and chroma information (Cb, Cr) defined as Y31, Cb31, and Cr31, respectively.

The remaining pixels have luminance information (Y) and chroma information (Cb, Cr) similarly defined.

The target pixel includes eight different types of three-times magnified patterns. In FIG. 9, the target pixel is shown having the patterns expressed by eight different types of bit strings. Respective pieces of luminance information (Y) and chroma information (Cb, Cr) on three sub-pixels that form the target pixel 22 are itemized for each of the three-times magnified patterns.

As discussed in connection with FIGS. 7(*a*)/7(*b*) and 9, the luminance and chroma information is determined for each sub-pixel on the basis of the weighted means. However, the weighted means may be defined by other expressions in addition to those as given in FIGS. 7–9.

FIG. 10 is a descriptive illustration, showing a set of weighted means expressions for determining luminance and chroma information for each sub-pixel. The expressions in FIG. 10 illustrate techniques for determining luminance information YX and chroma information CbX, CrX on a sub-pixel basis using weighted means. The value "n" in the expressions expresses the number of pixels to be used in determining the weighted means.

"A1"–"An" in the expression denote respective pieces of luminance information (Y) on the pixels for use in determining the weighted means. "B1"–"Bn" in the expression denote respective pieces of chroma information (Cb) on the pixels for use in determining the weighted means. "C1"–"Cn" in the expression represent respective pieces of chroma information (Cr) on the pixels for use in determining the weighted means. "m1"–"mn" in the expressions indicate respective weights.

In the weighted means according to the present embodiment, any pixel may be used to determine the weighted means. Therefore, in FIG. 10, any numeral may be substituted for "n" in the expressions. In addition the factors "m1"–"mn" in the expressions may be replaced by any numerals.

Pixels used to generate the luminance information must also be used to generate the chroma information. The same weights of a weighted means used to generate the luminance information must also be used to generate the chroma information.

For example, when the expressions as illustrated in FIG. 10 are reviewed with reference to FIG. 7, then it is found that: n=2; m1=m2=0.5; A1=Y3, A2=Y4; B1=Cb3, B2=Cb4; and, C1=Cr3, C2=Cr4.

The per sub-pixel luminance information storage unit 12 stores, in an amount equal to the amount in one original image data, the luminance information provided on a per sub-pixel basis by the per sub-pixel luminance information-generating unit 11 as previously described. The per sub-pixel chroma information storage unit 15 stores, using an amount of storage equal to one original image data, the chroma information provided on a per sub-pixel basis by the per sub-pixel chroma information-generating unit 14 as previously described.

As discussed above, the per sub-pixel luminance information-generating unit 11 generates the luminance information on a per sub-pixel basis merely by reproducing the luminance information on the target pixel. Alternatively it may generate the luminance information on a per sub-pixel basis on the basis of luminance information on a pixel adjacent to the target pixel as well as the luminance information on the target pixel using either reproduction or weighted means.

The use of the luminance information on the contiguously adjacent pixel next to the target as well as the luminance information on the target pixel allows the luminance information to be adjusted within fine limits for each sub-pixel. As a result, a smooth display is achievable.

However, when the luminance information is adjusted on a per sub-pixel basis, then the chroma information must be adjusted for each sub-pixel as well. Otherwise color irregularities occur between an image displayed on the display device 3 and an original image. Such a disadvantage is now described in detail.

Assume that luminance information is adjusted on a per sub-pixel basis, but not chroma information. Further assume that luminance information on a target pixel, luminance information on a leftward pixel next to the target pixel, and chroma information on the target pixel are defined as Y4, Y3, and Cr4, respectively.

Under this assumption, luminance information on a leftward sub-pixel of target pixel-forming three sub-pixels is generated by luminance information Y3 on the leftward pixel and reproduced onto the leftward sub-pixel, as illustrated in FIG. 5(*a*).

The luminance/chroma-synthesizing luminance/chroma-synthesizing unit 18 synthesizes luminance information Y3 on the leftward sub-pixel (or luminance information Y3 on the leftward pixel) with chroma information Cr4 on the target pixel, thereby determining the R-value of the leftward sub-pixel.

This step synthesizes the luminance and chroma information on different pixels to determine R-value of the leftward sub-pixel.

To determine R-value of the leftward sub-pixel from the synthesized luminance information Y on the leftward sub-pixel and chroma information Cr on the target pixel, the luminance/chroma-synthesizing unit 18 determines the "R" value on the basis of a formula, e.g., R=Y+1.371*Cr.

In FIG. 5(*a*), the leftward sub-pixel has value "R" expressed by the equation:

$$R = Y3 + 1.371 * Cr4.$$

Assuming that Y3=29.1 and Cr4=−43.9, then R is equal to 49.9. In this instance, the value of R is clipped as R=0.

Similar clipping may occur when respective values "G", "B" of the central and rightward sub-pixels are determined.

An image displayed with clipped sub-pixel RGB values exhibits color irregularities, when compared with an original image or an image entered via the display information input unit 1. To avoid the color irregularities, the chroma information as well as the luminance information is adjusted for each sub-pixel.

As illustrated in FIG. 5(*a*), when the luminance information on the leftward sub-pixel of the target pixel-forming three sub-pixels is generated by luminance information Y3 on the leftward pixel next to the target pixel are reproduced onto the leftward sub-pixel, then the chroma information on the leftward sub-pixel is generated by chroma information Cb3, Cr3 on the leftward pixel next to the target pixel are reproduced onto the leftward sub-pixel, as illustrated in FIG. 5(*b*).

The luminance/chroma-synthesizing unit 18 synthesizes luminance information Y3 on the leftward sub-pixel (or luminance information Y3 on the leftward pixel next to the target pixel) with chroma information Cr3 on the leftward sub-pixel (or chroma information Cr3 on the leftward pixel next to the target pixel), thereby determining the R-value of the leftward sub-pixel.

In brief, the luminance and chroma information are both synthesized on the same pixels to provide the R-value of the leftward sub-pixel.

Accordingly, the luminance/chroma-synthesizing unit 18 practices no clipping as opposed to the previous discussion. As a result, the occurrence of color irregularities is avoided between an original image and an image displayed on the basis of sub-pixel RGB values provided by the luminance/chroma-synthesizing unit 18.

[Filtering]

The filtering unit 16 filters the per sub-pixel luminance information contained in the per sub-pixel luminance information storage unit 12, and then places the filtering results into the corrected luminance information storage unit 17. This can be conducted according to filtering as illustrated in FIGS. 28–32, or may be performed as disclosed in the per sub-pixel display-related reference entitled "Sub-Pixel Font-Rendering Technology."

[Conversion From YCbCr to RGB]

The luminance/chroma-synthesizing unit 18 calculates respective sub-pixel RGB values using the per sub-pixel luminance information placed in the corrected luminance information storage unit 17 and the per sub-pixel chroma information included in the per sub-pixel chroma information storage unit 15, and then puts the calculation results into the display image storage unit 4.

More specifically, when the luminance/chroma-separating unit 6 divides original image data between luminance information Y and chroma information Cb, Cr using the aforesaid formulae:

$$Y = 0.299 * r + 0.587 * g + 0.114 * b,$$

$$Cb = -0.172 * r - 0.339 * g + 0.511 * b, \text{ and}$$

$$Cr = 0.511 * r - 0.428 * g - 0.083 * b,$$

then values of r, g, and b with reference to luminance Y and chroma Cb, Cr on a per-pixel basis are defined as:

$$r = Y + 1.371 * Cr;$$

$$g = Y - 0.698 * Cr + 0.336 * Cb; \text{ and,}$$

$$b = Y + 1.732 * Cb, \text{ respectively.}$$

These formulae are applied for each sub-pixel, thereby calculating the RGB values on per sub-pixel basis. The above formulae are given by way of illustration, and may be replaced by similar formulae.

Figure 11:
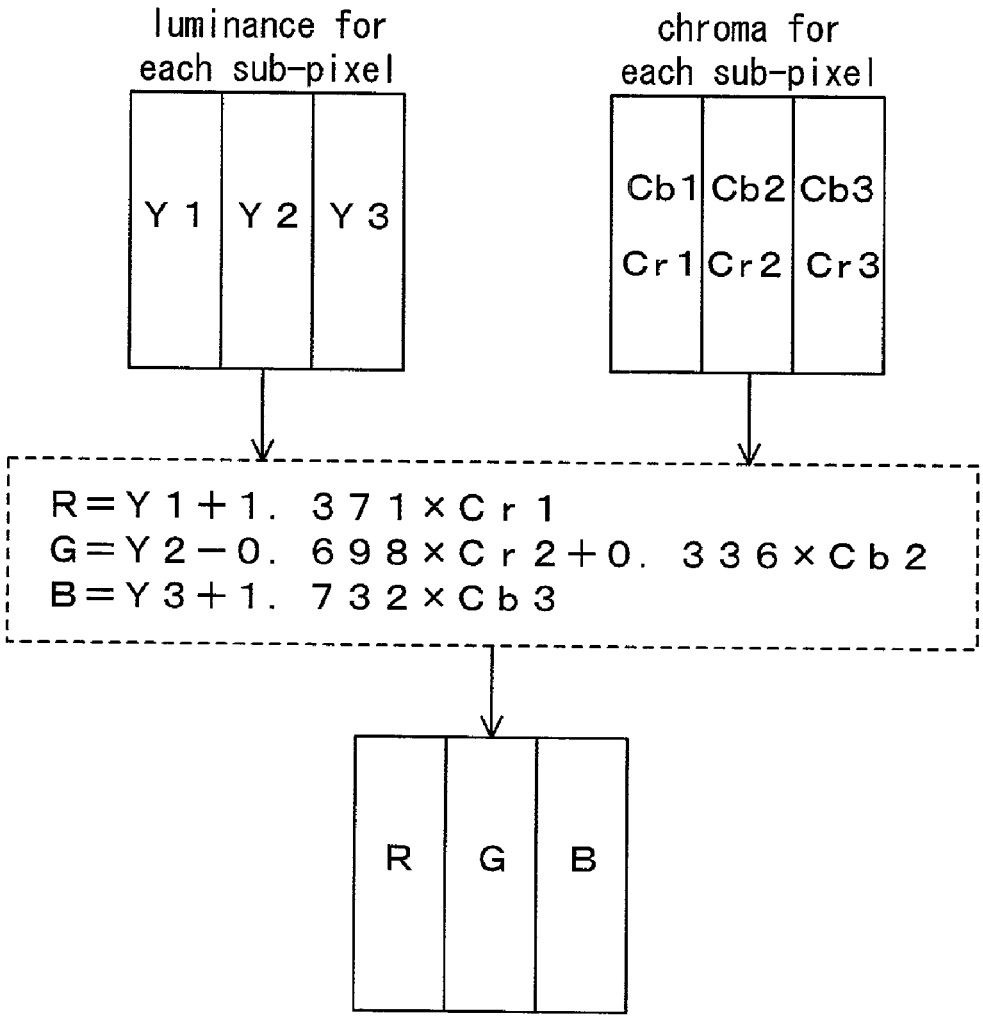
FIG. 11 is a descriptive illustration, showing how luminance and chroma information is converted into RGB.

FIG. 11 is a descriptive illustration, showing how RGB values are determined on the basis of luminance information and chroma information. Per sub-pixel luminance information (or luminance information filtered for each sub-pixel) contained in the corrected luminance information storage unit 17 is defined as Y1, Y2, and Y3. Per sub-pixel chroma information placed in the per sub-pixel chroma information storage unit 15 is defined as Cb1/Cr1, Cb2/Cr2, and Cb3/Cr3.

The RGB values are calculated for each sub-pixel in accordance with the following expressions:

$$R = Y1 + 1.371 * Cr1;$$

$$G = Y2 - 0.698 * Cr2 + 0.336 * Cb2; \text{ and}$$

$$B = Y3 + 1.732 * Cb3.$$

[Entire Flow of Processing]

A flow of processing is now described with reference to a flowchart and using the display equipment as illustrated in FIG. 1.

Figure 12:
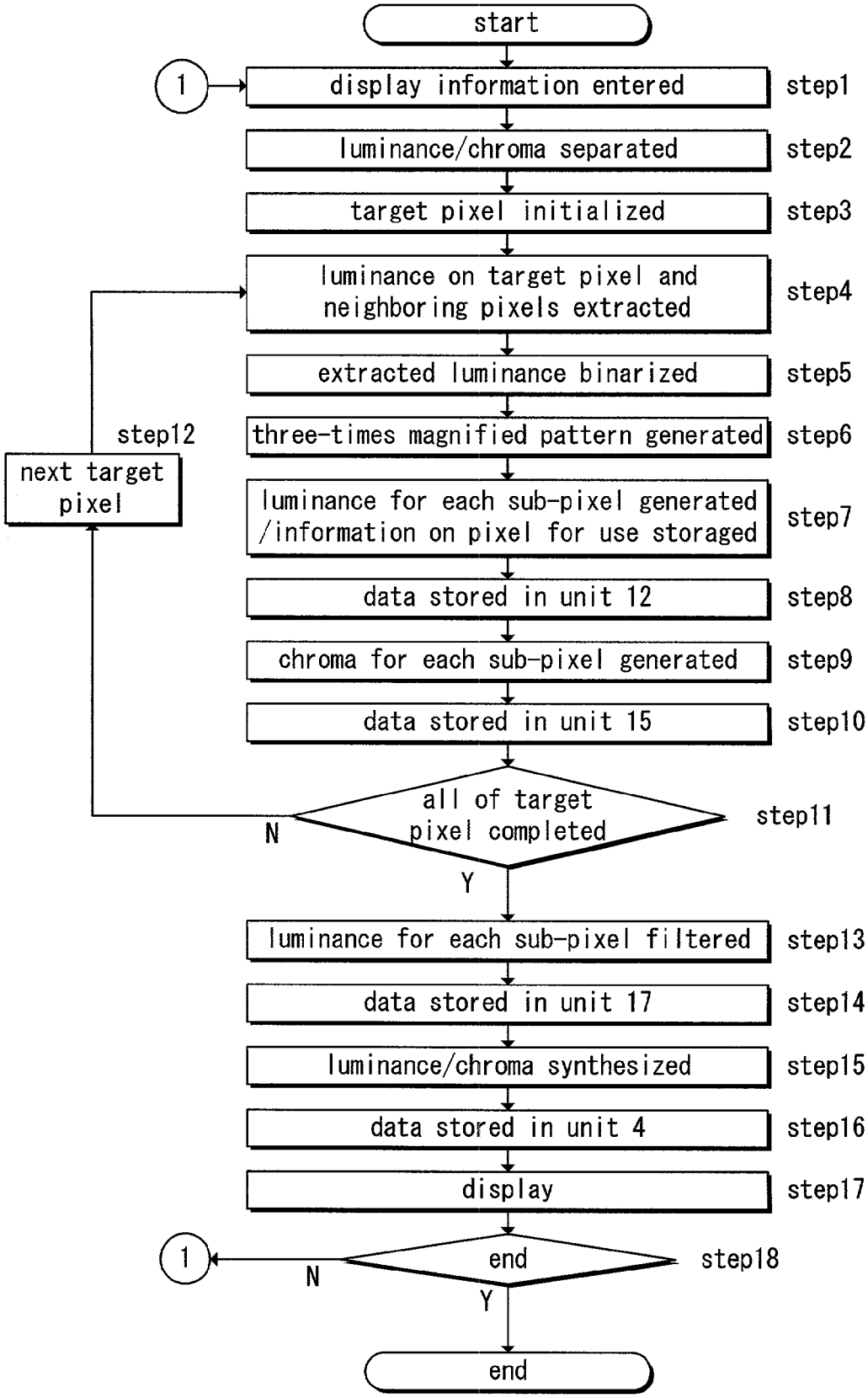
FIG. 12 is a flowchart, illustrating how display equipment behaves.

FIG. 12 is a flowchart, illustrating how the display equipment behaves. Display information (original image data) enters the display information input unit 1 at step 1.

At step 2, the luminance/chroma information-separating unit 6 separates the original image data in the original image data storage unit 5 between luminance information and chroma information. The luminance/chroma information-separating unit 6 then places the resulting luminance and chroma information into the original image luminance information storage unit 7 and the original image chroma information storage unit 8, respectively.

At step 3, the display control unit 2 defines a pixel at an upper-left initial position as a target pixel, and then instructs the binarizing unit 9 to binarize luminance information on the target pixel located at the initial position and respective pieces of luminance information on neighboring pixels about the target pixel.

At step 4, the binarizing unit 9 extracts the respective pieces of luminance information on the target pixel and neighboring pixels thereabout from the luminance information contained in the luminance information storage unit 7.

At step 5, the binarizing unit 9 binarizes the extracted luminance information using a threshold, and then feeds the resulting binary data back to the display control unit 2.

The display control unit 2 delivers the binary data (the binarized luminance information), upon receipt thereof from the binarizing unit 9, to the three-times magnified pattern-generating unit 10, and instructs the three-times magnified pattern-generating unit 10 to create a three-times magnified pattern.

At step 6, the three-times magnified pattern-generating unit 10 creates a three-times magnified pattern for the initially positioned target pixel in accordance with the binary data (bitmap pattern) that was sent from the display control unit 2, and then sends the generated pattern back to the display control unit 2.

The display control unit 2 passes the three-times magnified pattern of the target pixel, upon receipt thereof from the three-times magnified pattern-generating unit 10, over to the per sub-pixel luminance information-generating unit 11, and then instructs the sub-pixel luminance information-generating unit 11 to generate luminance information on a per sub-pixel basis.

At step 7, the per sub-pixel luminance information-generating unit 11 generates respective pieces of luminance information on target pixel-forming three sub-pixels in accordance with the three-times magnified pattern on the basis of the luminance information contained in the unit 8.

The per sub-pixel luminance information-generating unit 11 places into the referenced pixel information storage unit 13 the following:

one piece of information as to whether or not the respective pieces of luminance information on the target pixel-forming three sub-pixels were generated using luminance information on a pixel adjacent to the target pixel; and, another piece of information as to which pixel was used to produce the luminance information on the three sub-pixels when the answer to the previous information results in an affirmative response.

At step 8, the per sub-pixel luminance information-generating unit 11 brings the luminance information generated on a per sub-pixel basis into the per sub-pixel luminance information storage unit 12.

At step 9, the display control unit 2 instructs the per sub-pixel chroma information-generating unit 14 to generate respective pieces of chroma information on the target pixel-forming three sub-pixels.

The per sub-pixel chroma information-generating unit 14 generates the chroma information on the three sub-pixels according to the chroma information contained in the original image chroma information storage unit 8 with reference to the information placed in the referenced pixel information storage unit 13.

At step 10, the per sub-pixel chroma generating unit 14 places the chroma information generated for each sub-pixel into the per sub-pixel chroma information storage unit 15.

At step 12, while defining every pixel as a target pixel, the display control unit 2 repeats the processing of steps 4-10 until all of the target pixels are processed at step 11.

At step 13, when the repeated processing is completed, the display control unit 2 instructs the filtering unit 16 to filter the per sub-pixel luminance information placed in the per sub-pixel luminance information storage unit 12.

At step 14, the filtering unit 16 places the filtered per sub-pixel luminance information into the corrected luminance information storage unit 17 at step 14.

At step 15, the luminance/chroma information-synthesizing unit 18 determines respective sub-pixel ROB values on the basis of the per sub-pixel luminance information in the corrected luminance information storage unit 17 and the per sub-pixel chroma information in the per sub-pixel chroma information storage unit 15.

At step 16, the luminance/chroma-synthesizing unit 18 brings the determined sub-pixel RGB values into the display image storage unit 4.

At step 17, the display control unit 2 allocates the respective sub-pixel RGB values to pixel-forming three light-emitting elements of the display device 3 in accordance with the sub-pixel ROB values contained in the display image storage unit 4, thereby displaying an image on the display device 3.

At step 18, the display control unit 2 returns the routine to step 1 when display is non-terminated.

The description of FIG. 12 details how the luminance information is binarized for each target pixel. Alternatively, the entire luminance information on an original image placed in the luminance information storage unit 7 may be binarized in advance. Such convenient binarization is expected to result in less processing.

[Details of Three-Times Magnified Pattern-Generating Method]

The following describes in detail how the three-times magnified pattern-generating unit 10 generates a three-times magnified pattern. The method includes pattern matching and logic operation. The pattern matching is described first.

Figure 13:
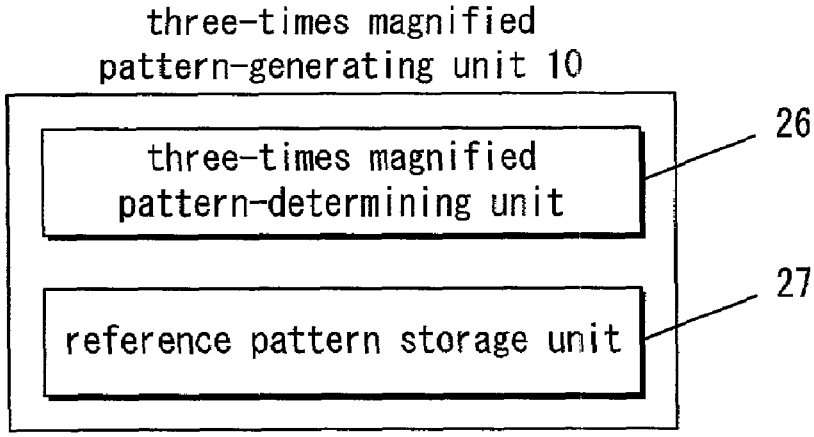
FIG. 13 is an illustration, showing a three-times magnified pattern-generating unit by way of illustration.

FIG. 13 illustrates the three-times magnified pattern-generating unit 10 of FIG. 1 by way of illustration. The three-times magnified pattern-generating unit 10 includes a three-times magnified pattern-determining unit 26 and a reference pattern storage unit 27.

The binarizing unit 9 extracts respective pieces of luminance information on a target pixel and neighboring pixels about the target pixel from the original image luminance information storage unit 7 before the three-times magnified pattern-generating unit 10 starts creating a three-times magnified pattern.

The binarizing unit 9 binarizes the extracted luminance information using a threshold, thereby providing a bitmap pattern representative of the target pixel and neighboring pixels thereabout. The bitmap pattern is identical in shape to a corresponding reference pattern.

Figure 14:
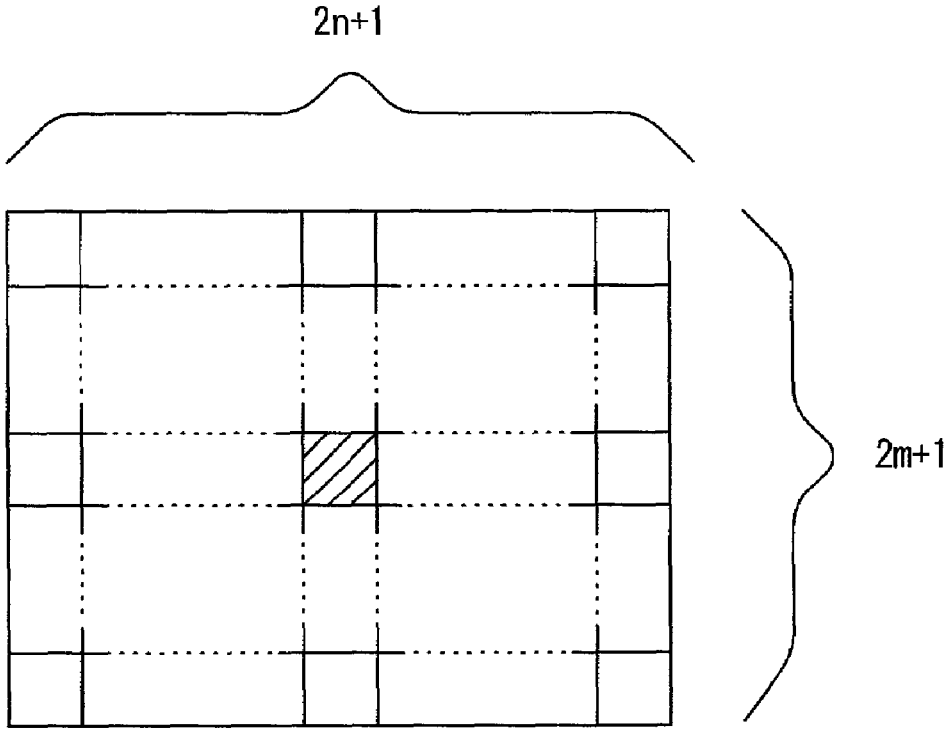
FIG. 14 is an illustration, showing how a reference pattern is defined in the three-times magnified pattern-generating unit.
Figure 15A:
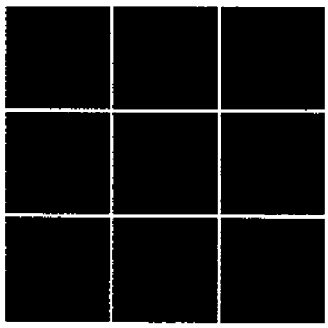
FIG. 15(*a*) is an illustration, showing a reference pattern by way of illustration in the three-times magnified pattern-generating unit.
Figure 15B:
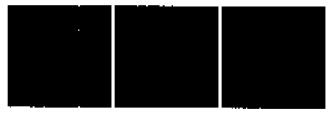
Figure 15C:
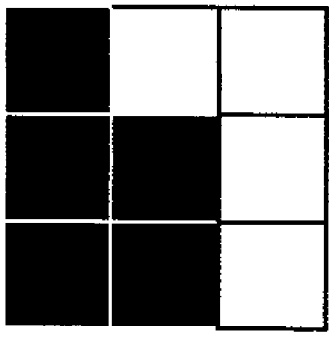
Figure 15D:
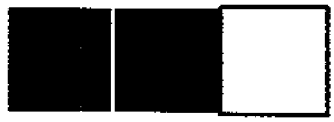
Figure 15E:
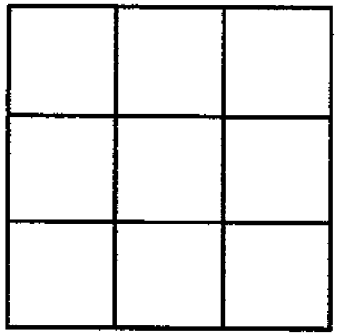
Figure 15F:
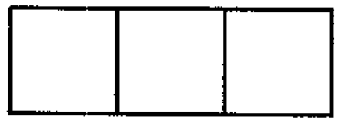

In general, the bitmap pattern is defined as illustrated in FIG. 14. More specifically, a central pixel defined by slanted lines as a target pixel and surrounding pixels thereabout form the pattern in which the total number of the pixels is (2n+1) times (2m+1) ("n" and "m" are natural numbers). The pattern includes different combinations of 2 raised to the power of (2n+1)*(2m+1).

The numbers n, m are preferably defined as n=m=1 to reduce the system load. Therefore, the pattern is formed by three pixels-by-three pixels, to include five hundred and twelve (512) different combinations. The following description is based on the three pixels-by-three pixels, but may be replaced by other patterns such as three pixels-by-five pixels and five pixels-by-five pixels.

When the three pixel-by-three pixel pattern is all black as illustrated in FIG. 15(*a*), then the resulting three-times magnified pattern has a central pixel and contiguously adjacent pixels next thereto all rendered black.

Conversely, when the pattern is all white as illustrated in FIG. 15(*e*), then the resulting three-times magnified pattern has the central and contiguous adjacent pixels all rendered white as shown in FIG. 15(*f*).

For a variety of intermediate patterns between the above opposite patterns, three-times magnified pattern-determining rules are established in advance. When the rules are all set up, then 512-different combinations as previously discussed are defined. Alternatively, fewer rules may be pre-established in view of symmetry and black-white conversion.

The above discusses pattern matching as a first example, but, as discussed below, bits may express the pattern matching.

Figures 16, 17:
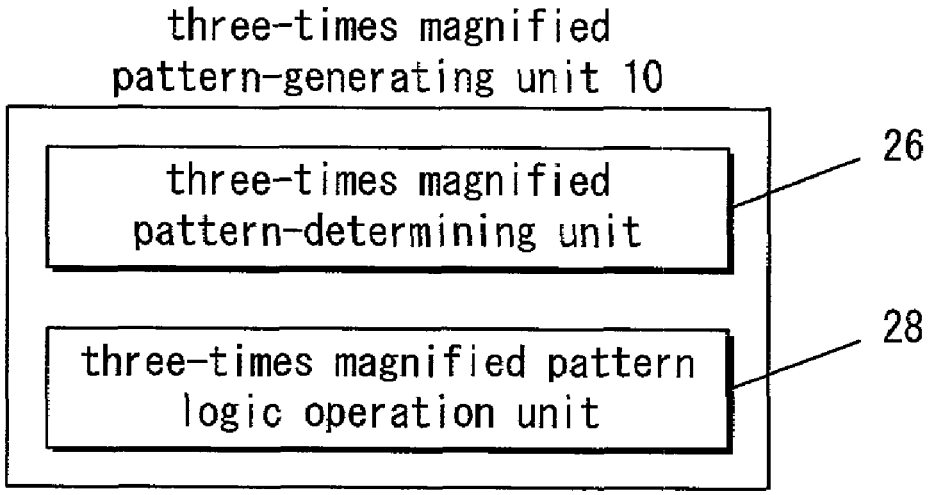
FIG. 16 is an illustration, showing a relationship between bit strings and three-times magnified patterns in the three-times magnified pattern-generating unit.
FIG. 17 is an illustration, showing another three-times magnified pattern-generating unit by way of illustration.

As illustrated in FIG. 16, assume that blacks and whites are defined as 0 and 1, respectively. The blacks and whites in the three pixels-by-three pixels ranging from an upper-left pixel thereof to a lower-right pixel thereof may be expressed by a bit string (nine digits) in which numerals 0, 1 are aligned with one another in sequence.

When the three pixel-by-three pixel pattern is entirely black as shown in FIG. 15(*a*), then the pattern and a corresponding three-times magnified pattern may be expressed by bit string 000000000 and bit string 000, respectively.

Conversely, when the three pixel-by-three pixel pattern is entirely white as shown in FIG. 15(*e*), then the pattern and a corresponding three-times magnified pattern may be expressed by bit string 111111111 and bit string 111, respectively.

Similarly, even with such an expression using the bit string, three-times magnified pattern-determining rules are established in advance for a variety of intermediate patterns between the bit strings 000000000 and 111111111. When the rules are set up, then five hundred twelve different combinations as previously discussed are defined. Alternatively, fewer rules may be pre-established by omitting part of the rules in view of symmetry and black-white conversion.

The rules using the bit string are placed into the reference pattern storage unit 27, in which the reference pattern is correlated with the three-times magnified pattern using an arrangement or other known storage structures, while the bit strings are itemized by indexes. This system allows a desired three-times magnified pattern to be found immediately when the reference pattern storage unit 27 is referenced by a corresponding index.

As discussed above, the reference pattern storage unit 27 stores the reference pattern and the three-times magnified pattern correlated therewith.

Other equivalent notations such as a hexadecimal notation may, of course, replace the nine-digit bit string.

In FIG. 13, the three-times magnified pattern-determining unit 26 references the reference pattern storage unit 27, and then determines a three-times magnified pattern by mean of either pattern matching, as illustrated in FIG. 15, or search according to the index, as illustrated in FIG. 16.

Another method for generating a three-times magnified pattern according to logic operation is now described.

FIG. 17 illustrates another example of the three-times magnified pattern-generating unit 10 of FIG. 1. The three-times magnified pattern-generating unit 10 includes a three-times magnified pattern-determining unit 26 and a three-times magnified pattern logic operation unit 28.

Different from pattern matching, the present method determines a three-times magnified pattern by logic operation. It performs this, without storing the three-time magnified pattern-determining rules. For this reason, the three-times magnified pattern logic operation unit 28 as illustrated in FIG. 17 is substituted for the reference pattern storage unit 27 as shown in FIG. 13.

The three-times magnified pattern logic operation unit 28 performs logic operation with reference to a bitmap pattern (binary data) provided by the binarizing unit 9, thereby providing a three-times magnified pattern for a target pixel.

The following describes in detail with reference to FIGS. (A) to 18(*g*) how the three-times magnified pattern logic operation unit 28 practices the logic operation. The three-times magnified pattern logic operation unit 28 includes functions whereby the three-times magnified pattern logic operation unit 28 judges conditions as illustrated in FIGS. 18(*b*) to 18(*g*). The conditions are related to a total of three pixels-by-three pixels that consists of a central target pixel (0, 0) and neighboring pixels thereabout. The result is a three-times magnified pattern-determining three digit bit value as a return value according to the judgment results. The symbol * as illustrated in FIGS. 18(*b*) to 18(*g*) means that the pixel is ignored, whether white or black.

As illustrated in FIG. 18(*b*), when the target pixel and horizontally contiguously adjacent pixels next to the target pixel are all black, then the return value 111 results. As illustrated in FIG. 18 i(*c*), the return value 000 results when the target pixel and the horizontally contiguously adjacent pixels thereabout are all white.

As illustrated in FIGS. 18(*d*) to 18(*g*), the three-times magnified pattern logic operation unit 28 includes other operable logics.

It would be understood from the above description that the use of the logic operation makes it feasible to determine the three-times magnified pattern in a manner similar to pattern matching. The logic operation depends upon how operation is practiced, not on how large a storage area is used. Thus, the logic operation can be installed with ease in equipment having a limited storage area.

A combination of logic operation and pattern matching can, of course, produce a three-times magnified pattern as well. For example, a two-step process is acceptable, in which the reference pattern storage unit 27, and the three-times magnified pattern logic operation unit 28 provide respective courses of processing. In certain applications, either the reference pattern storage unit 27 or the three-times magnified pattern logic operation unit 28 may provide an earlier action.

Since three sub-pixels forms a single pixel, storing luminance and chroma information for each sub-pixel requires a storage area three times as large as that used to store the luminance and chroma information on a pixel-by-pixel basis.

In view of the above, the luminance and chroma information may be generated on a per sub-pixel basis only with reference to any target pixel that is positioned at a boundary when the luminance information is binarized on a pixel-by-pixel basis. As a result, the generated luminance and chroma information require only a limited storage area. This means that the per sub-pixel luminance information storage unit 12 and the per sub-pixel chroma information storage 15 can include smaller storage areas.

Meanwhile, the previous description, as illustrated in FIG. 12, presupposes that the luminance and chroma information is generated on a per sub-pixel basis with reference to all target pixels, and the per sub-pixel luminance information storage unit 12 and the per sub-pixel chroma information storage unit 15 must include storage areas in which the respective pieces of luminance and chroma information on the three sub-pixels are contained for all of the target pixels.

Embodiment 2

A second embodiment is now described only with respect to differences in structure between the previous embodiment and the present embodiment.

Figure 19:
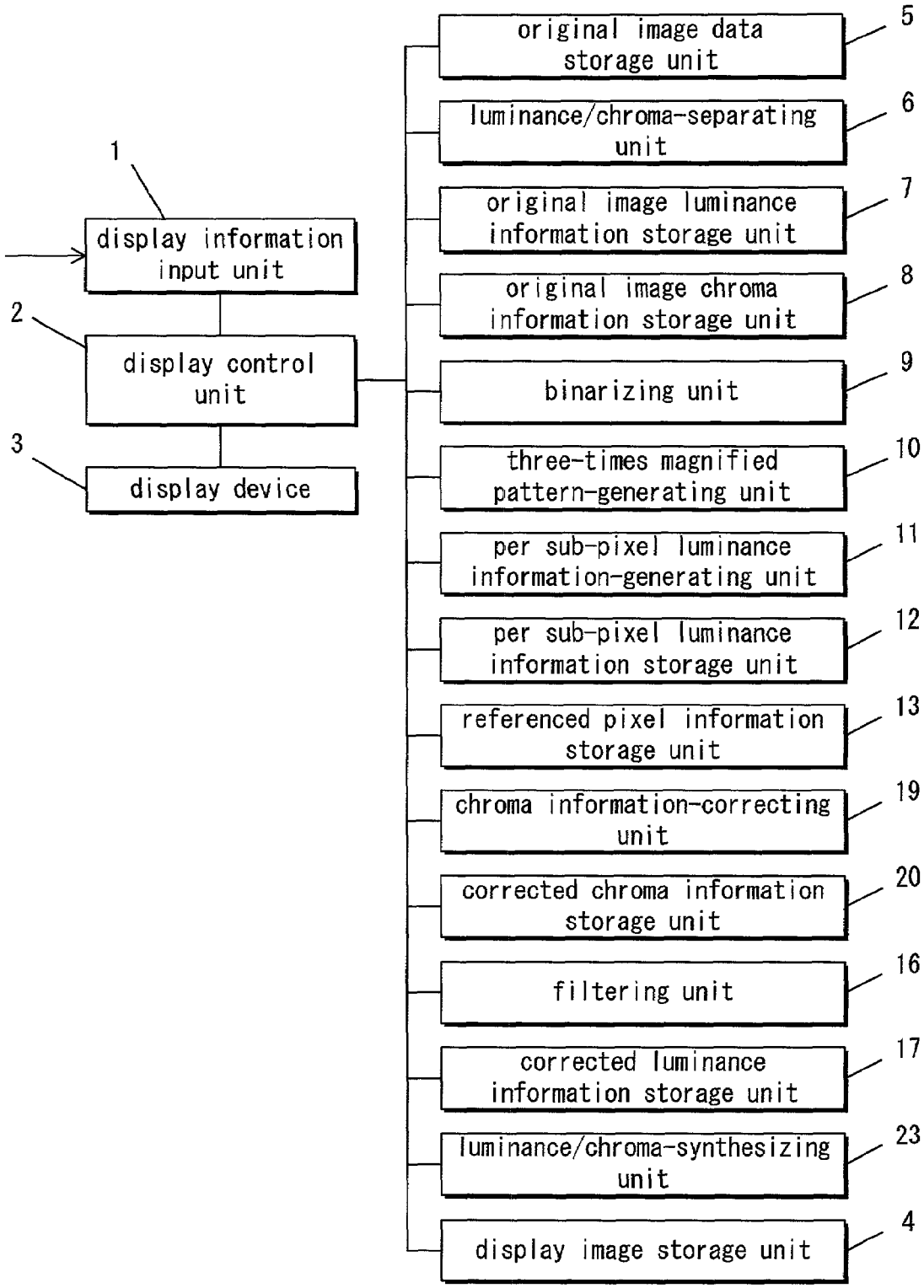
FIG. 19 is a block diagram, illustrating display equipment according to a second embodiment.

FIG. 19 illustrates display equipment according to the second embodiment. This embodiment differs from the previous embodiment in that different types of chroma information are newly generated on a pixel-by-pixel basis, depending upon how luminance information is produced for each sub-pixel, instead of generating the chroma information on a per sub-pixel basis. As illustrated in FIG. 19, a chroma information-correcting unit 19, a corrected chroma information storage unit 20, and a luminance/chroma-synthesizing unit 23 are substituted for the per sub-pixel chroma information-generating unit 14, the per sub-pixel chroma information storage unit 15, and the luminance/chroma-synthesizing unit 18 as shown in FIG. 1.

The manner in which how the chroma information-correcting unit 19 practices a chroma information-correcting step is now described. The chroma information-correcting unit 19 adopts chroma information on a target pixel as corrected chroma information on the target pixel when respective pieces of luminance information on target pixel-forming three sub-pixels are generated by luminance information on the target pixel are reproduced onto the three sub-pixels, or when the luminance information on each of the three sub-pixels is generated without using luminance information on a pixel adjacent to the target pixel.

The chroma information-correcting unit 19 generates corrected chroma information on the target pixel using a weighted means that includes chroma information on the pixel adjacent to the target pixel and chroma information on the target pixel when the luminance information on any one of the three sub-pixels is generated using the luminance information on the pixel adjacent to the target pixel.

An illustrative example is now described.

Figure 20:
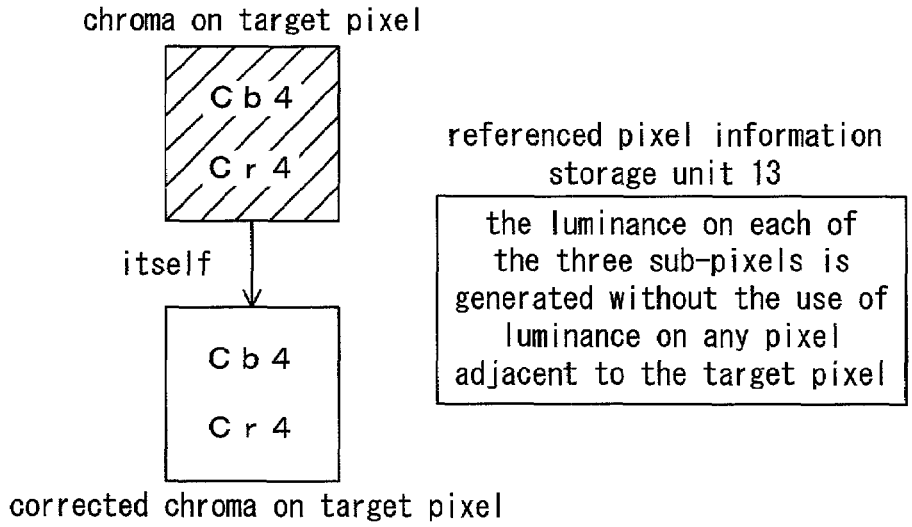
FIG. 20 is an illustration, showing how corrected chroma information is generated by way of illustration.

FIG. 20 illustrates how corrected chroma information on a target pixel is generated by way of illustration. As illustrated in FIG. 20(*a*), the chroma information-correcting unit 19 adopts chroma information Cb4, Cr4 on the target pixel as corrected chroma information (Cb, Cr) on the target pixel when luminance information on each of target pixel-forming three sub-pixels is generated without the use of luminance information on a pixel adjacent to the target pixel, as illustrated in FIG. 4(*a*).

The chroma information-correcting unit 19 references the referenced pixel information storage unit 13 to ascertain that the luminance information on each of the three sub-pixels is generated without using the luminance information on the pixel next to the target pixel.

Figure 21:
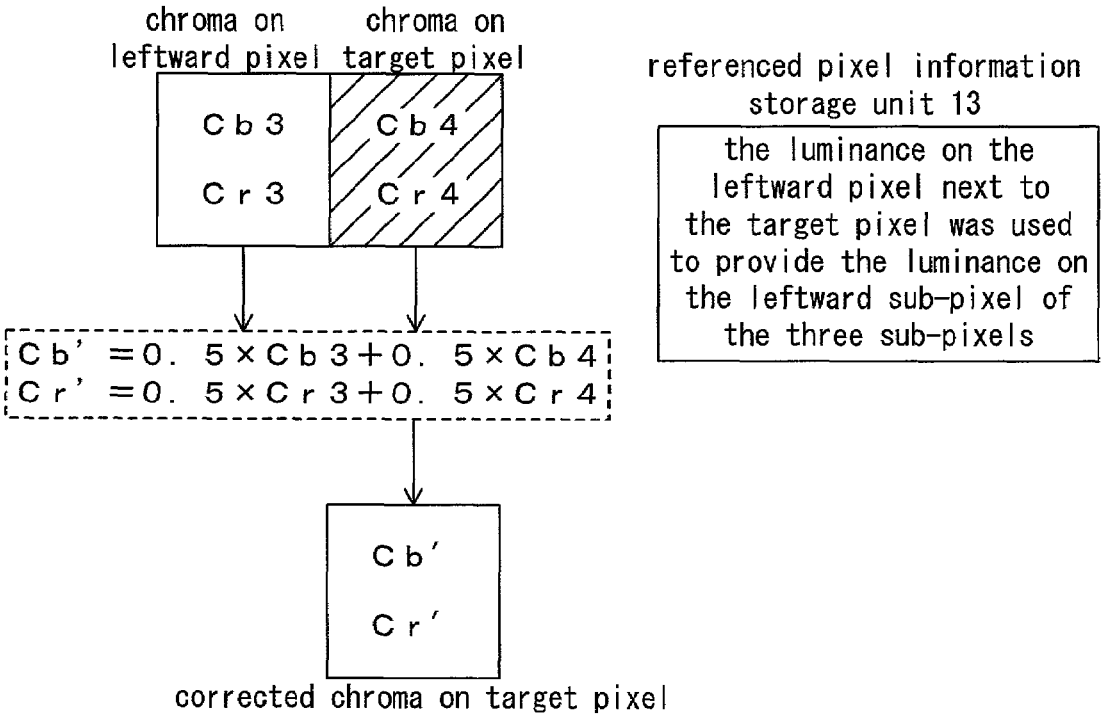
FIG. 21 is a further illustration, showing how corrected chroma information is generated by way of illustration.

FIG. 21 illustrates how corrected chroma information on the target pixel is generated as a further illustration. The chroma information-correcting unit 19 generates corrected chroma information Cb', Cr' on the target pixel using weighted means that include chroma information Cb4, Cr4 on the target pixel and chroma information Cb3, Cr3 on a leftward pixel next to the target pixel, respectively, when luminance information on a leftward sub-pixel of the target pixel-forming three sub-pixels is generated using luminance information on the leftward pixel adjacent to the target pixel, as illustrated in FIGS. 5(*a*) and 7(*a*).

More specifically, corrected chroma information Cb', Cr' on the target pixel is generated on the basis of expressions $$Cb'=0.5*Cb3+0.5*Cb4,$$

$$Cr'=0.5*Cr3+0.5*Cr4, \text{ respectively,}$$

The chroma information-correcting unit 19 references the referenced pixel information storage unit 13 to ascertain that the luminance information on the leftward sub-pixel of the target pixel-forming three sub-pixels is generated using the luminance information on the leftward pixel next to the target pixel.

As illustrated in FIG. 21, the corrected chroma information on the target pixel is produced using the weighted means. However, such a weighted means-determining expression is not limited to the above. Instead, the expressions as shown in FIG. 10 may be used as weighted means expressions. However, the same pixel used to determine the luminance information on a per sub-pixel basis must also be employed to determine the corrected chroma information on the target pixel.

The corrected chroma information storage unit 20 stores, by an amount of original image data, the corrected chroma information provided by the chroma information-correcting unit 19.

It is now described how the luminance/chroma-synthesizing unit 23 practices a luminance/chroma-synthesizing process.

The luminance/chroma-synthesizing unit 23 calculates respective sub-pixel RGB values on the basis of the per sub-pixel luminance information in the corrected luminance information storage unit 17 and the corrected chroma information contained in the unit 20, and then places the calculation results into the display image storage unit 4.

More specifically, when the luminance/chroma-separating unit 6 separates original image data between luminance information Y and chroma information Cb, Cr using the formulae (Y=0.299*r+0.587*g+0.114*b, Cb=−0.172*r−0.339*g+0.511*b, and Cr=0.511*r−0.428*g−0.083*b) as given in the first embodiment, then values of r, g, and b with reference to per sub-pixel luminance Y and chroma Cb, Cr are determined according to the formulae defined as r=Y+1.371*Cr, g=Y−0.698*Cr+0.336*Cb, and b=Y+1.732*Cb.

The formulae are given for each sub-pixel, thereby calculating RGB values on a per sub-pixel basis. The above formulae are shown by way of illustration, and may be replaced by other similar formulae.

Figure 22:
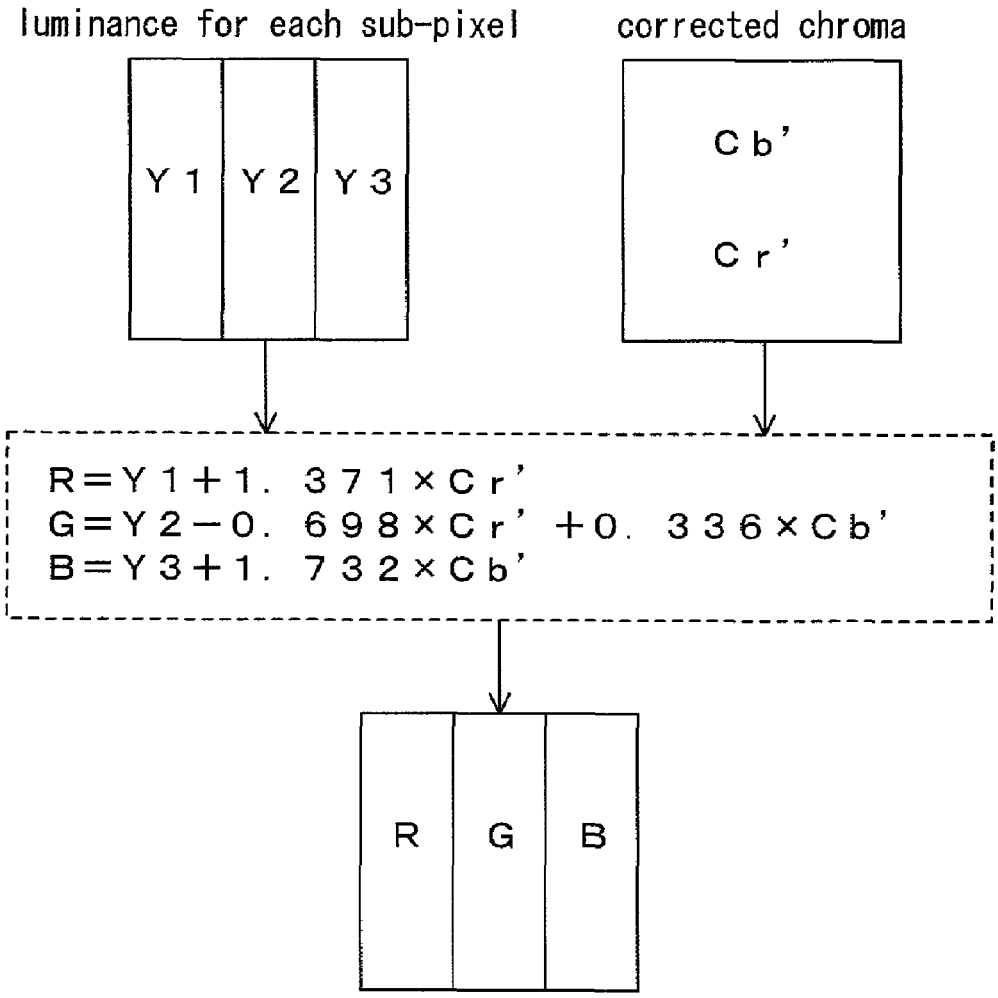
FIG. 22 is a descriptive illustration, showing how luminance information as well as the corrected chroma information is converted into RGB.

FIG. 22 is a descriptive illustration, showing how RGB values are calculated from luminance information and corrected chroma information. The per sub-pixel luminance information (the filtered per sub-pixel luminance information) contained in the corrected luminance information storage unit 17 is defined as Y1, Y2, and Y3.

The corrected chroma information contained in the unit 20 is defined as Cb' and Cr'.

The RGB values are calculated for each sub-pixel from expressions defined as R=Y1+1.371*Cr', G=Y2−0.698*Cr'+0.336*Cb', and B=Y3+1.732*Cb'.

The RGB values thus obtained on a per sub-pixel basis using the luminance/chroma-synthesizing unit 23 are placed into the display image storage unit 4.

The flow of processing is now described with reference to the flowchart of FIG. 23 and using the display equipment as shown in FIG. 19. Only the differences in the flowchart from the previous embodiment as illustrated in FIG. 12 are described.

Figure 23:
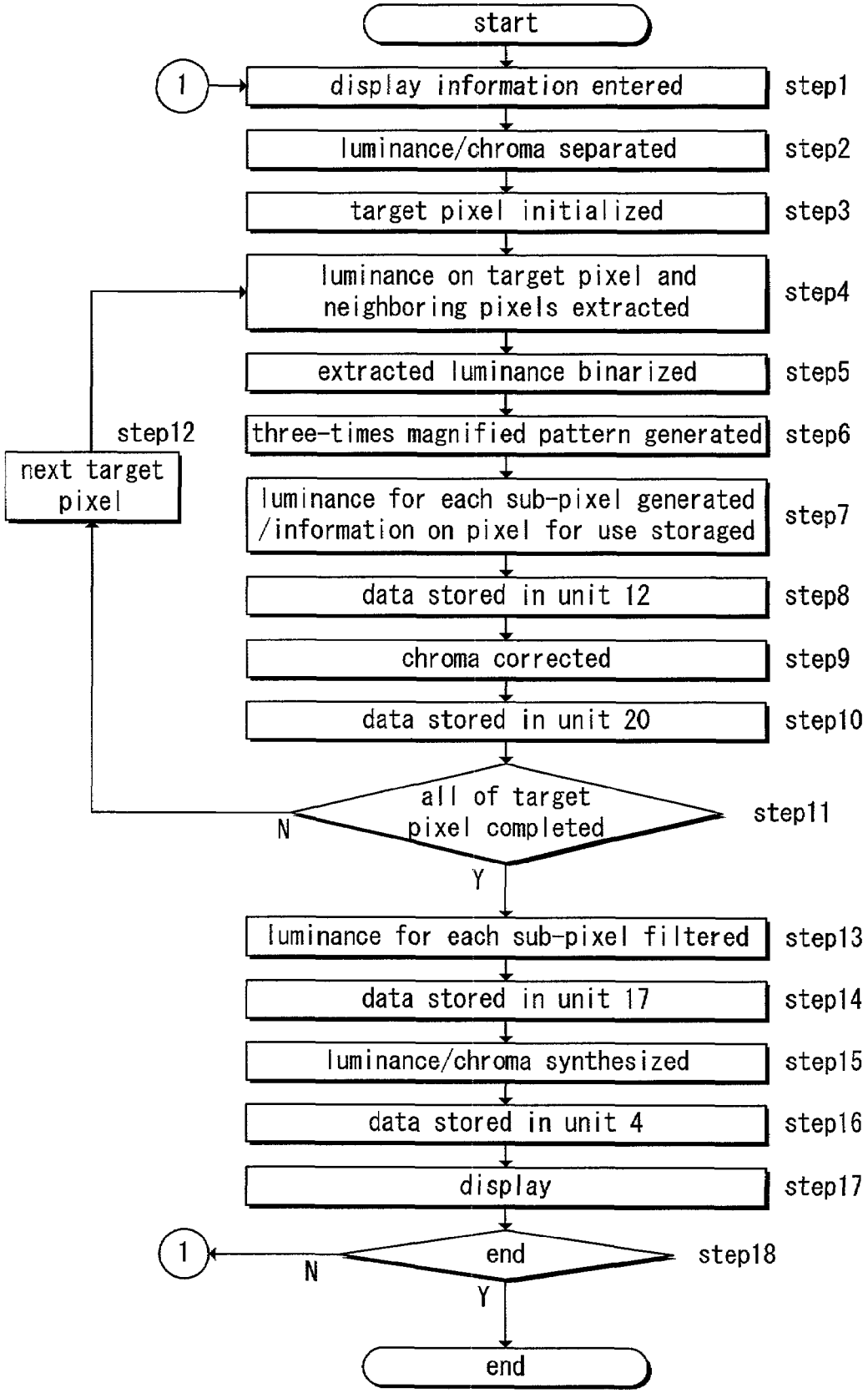
FIG. 23 is a flowchart, illustrating how display equipment behaves.

In the flowchart of FIG. 23, step 9 correcting chroma information) and step 10 (placing the corrected chroma information into the corrected luminance information storage unit 17) are substituted for step 9 (generating chroma information for each sub-pixel) and step 10 (placing the generated per sub-pixel chroma information into the per sub-pixel chroma information storage unit 15), respectively.

Therefore, the steps 1–8 in FIG. 23 are similar to those in FIG. 12. The display control unit 2 instructs the chroma information-correcting unit 19 at step 9 to generate corrected chroma information on a target pixel.

While referencing information contained in the referenced pixel information storage unit 13, the chroma information-correcting unit 19 generates the corrected chroma information on the target pixel on the basis of chroma information stored in the original image chroma information storage unit 8.

The chroma information-correcting unit 19 brings the resulting corrected chroma information into the corrected chroma information storage unit 20 at step 10.

Steps 11–14 are similar to those of FIG. 12. The luminance/chroma-synthesizing unit 23 determines sub-pixel RGB values at step 15 using the per sub-pixel luminance information in the corrected luminance information storage unit 17 and the corrected chroma information in the unit 20.

The luminance/chroma-synthesizing unit 23 places the determined RGB values into the display image storage unit 4 at step 16. Steps 17–18 are similar to those of FIG. 12.

As described above, pursuant to the present embodiment, the chroma information-correcting unit 19 generates the corrected chroma information on the target pixel using the same pixel that is used to generate the luminance information on a per sub-pixel basis.

As a result, the occurrence of color irregularities is inhibited between a multi-value image displayed on the display device 3 on a per sub-pixel basis and a multi-value image (original image) entered on a pixel-by-pixel basis. This feature is similar to that of the previous embodiment.

The present embodiment provides beneficial effects that are now discussed in comparison with those of the previous embodiment.

Pursuant to the present embodiment, the chroma information-correcting unit 19 generates the corrected chroma information on the target pixel on a pixel-by-pixel basis. In contrast, according to the previous embodiment, the per sub-pixel chroma information-generating unit 14 (see FIG. 1) produces chroma information for each sub-pixel. A single pixel consists of three sub-pixels. Therefore, the chroma information produced for each sub-pixel according to the previous embodiment has a data quantity three times as great as that of the chroma information generated on a pixel-by-pixel basis.

As a result, the present embodiment puts the chroma information into a limited storage area, when compared with the previous embodiment. More specifically, the corrected chroma information storage unit 20 according to the present embodiment can include a storage capacity as small as one third of that of the per sub-pixel chroma information storage unit 15 (see FIG. 1) according to the previous embodiment.

Note that the per sub-pixel luminance information and the corrected chroma information on the target pixel may be determined only with reference to any target pixel located at a boundary when the luminance information is binarized on a pixel-by-pixel basis.

As a result, the corrected chroma information and per sub-pixel luminance information can be contained in a limited storage area, when compared with the case in which the corrected chroma information and per sub-pixel luminance information on all target pixels is generated as illustrated in FIG. 23. This means that the corrected chroma information storage unit 20 and the per sub-pixel luminance information storage unit 12 can include smaller storage capacities.

Embodiment 3

Figure 24:
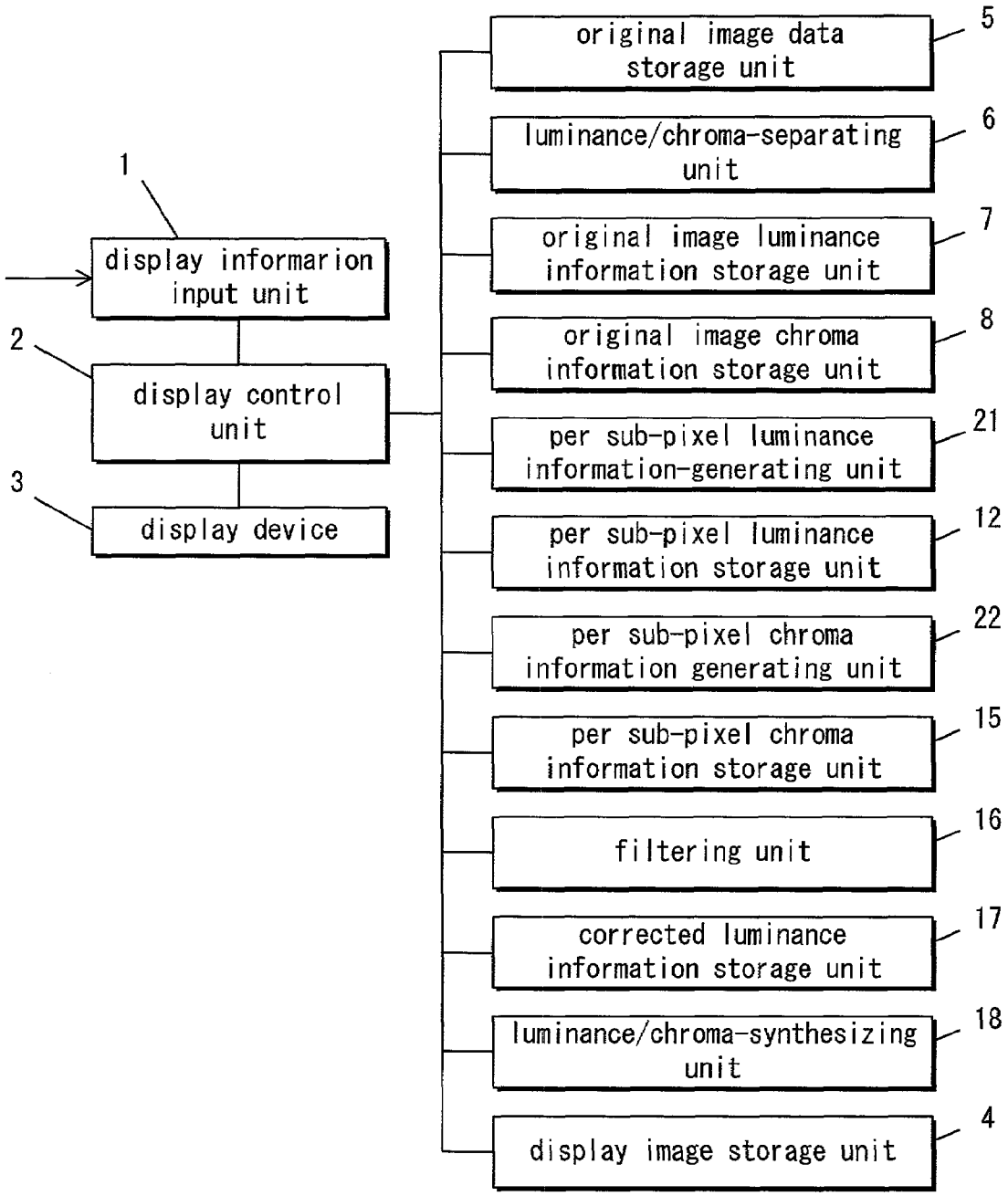
FIG. 24 is a block diagram, illustrating display equipment according to a third embodiment.

A third embodiment is now described only with respect to differences in structure between the first embodiment and the present embodiment FIG. 24 is a block diagram, illustrating display equipment according to the present embodiment. Different from the first embodiment, the present embodiment mechanically provides luminance and chroma information for each sub-pixel using weighted means, not in the way in which luminance and chroma information are produced on a per sub-pixel basis according to a three-times magnified pattern that is derived from a bitmap pattern formed by a target pixel and neighboring pixels thereabout.

As illustrated in FIG. 24, a per sub-pixel luminance information-generating unit 21 and a per sub-pixel chroma information-generating unit 22 are substituted for the binarizing unit 9, the three-times magnified pattern-generating unit 10, the per sub-pixel luminance information-generating unit 11, the referenced pixel information storage unit 13, and the per sub-pixel chroma information-generating unit 14 as shown in FIG. 1.

It is now discussed how the per sub-pixel luminance information-generating unit 21 generates luminance information.

The per sub-pixel luminance information-generating unit 21 generates respective pieces of luminance information on two sub-pixels of target pixel-forming three sub-pixels at opposite ends thereof using respective weighted means that include luminance information on a target pixel and respective pieces of luminance information on contiguously adjacent pixels next to the target pixel.

The per sub-pixel luminance information-generating unit 21 further generates luminance information on a central sub-pixel of the three sub-pixels by reproducing the luminance information on the target pixel onto the central sub-pixel.

The following describes how the per sub-pixel chroma information-generating unit 22 generates chroma information.

The per sub-pixel chroma information-generating unit 22 generates respective pieces of chroma information on two sub-pixels of the target pixel-forming three sub-pixels at opposite ends thereof using respective weighted means that include chroma information on the target pixel and respective pieces of chroma information on the contiguously adjacent sub-pixels next thereto.

The same pixels used to generate the luminance information must be used to generate the chroma information. The same weights of the weighted means used to generate the luminance information must be used to generate the chroma information.

The per sub-pixel chroma information-generating unit 22 further generates chroma information on the central sub-pixel of the three sub-pixels by reproducing the chroma information on the target pixel onto the central sub-pixel.

Further detail is now given with reference to an illustrative example.

Figure 25A:
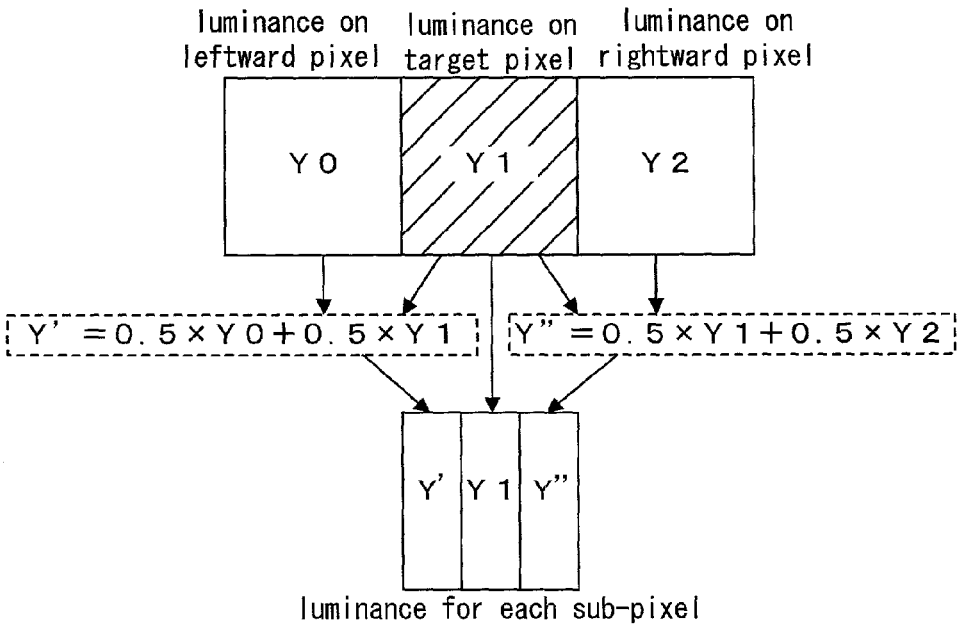
FIG. 25(*a*) is a descriptive illustration, showing how luminance information is generated using weighted means.
Figure 25B:
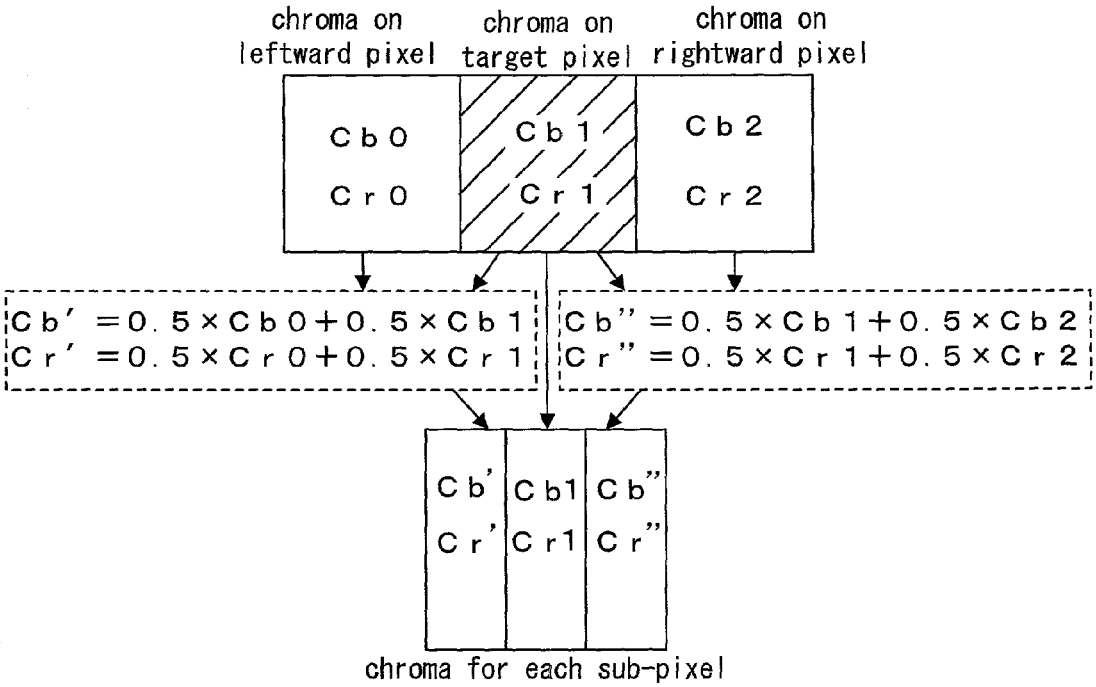

FIGS. 25(*a*) and 25(*b*) are descriptive illustrations, showing how luminance and chroma information is generated on a per sub-pixel basis using weighted means. FIG. 25(*a*) illustrates one example of providing the luminance information, while FIG. 25(*b*) shows another example of producing the chroma information.

As illustrated in FIG. 25(*a*), the per sub-pixel luminance information-generating unit 21 generates luminance information Y' on a leftward sub-pixel of target pixel-forming three sub-pixels using a weighted means that includes luminance information Y0 on a leftward pixel next to a target pixel and luminance information Y1 on the target pixel.

Luminance information Y' is determined from the expression:

$$Y'=0.5*Y0+0.5*Y1.$$

The per sub-pixel luminance information-generating unit 21 generates luminance information Y" on a rightward sub-pixel of the target pixel-forming three sub-pixels using a similar weighted means.

The per sub-pixel luminance information-generating unit 21 generates luminance information on a central sub-pixel of the three sub-pixels by reproducing luminance information Y1 on the target pixel onto the central sub-pixel.

As illustrated in FIG. 25(*b*), the per sub-pixel chroma information-generating unit 22 generates chroma information Cb' on the leftward sub-pixel of the target pixel-forming three sub-pixels using a weighted means that includes luminance information Cb0 on the leftward pixel and luminance information Cb1 on the target pixel.

Chroma information C' is determined from the expression:

$$Cb'=0.5*Cb0+0.5*Cb1.$$

The per sub-pixel chroma information-generating unit 22 generates chroma information Cr' on the leftward sub-pixel of the three sub-pixels using a weighted means that includes luminance information Cr0 on the leftward pixel and luminance information Cr1 on the target pixel.

Chroma information Cr' is obtained from the expression:

$$Cr'=0.5*Cr0+0.5*Cr1.$$

The per sub-pixel chroma information-generating unit 22 generates chroma information Cb", Cr" on the rightward sub-pixel of the three sub-pixels using similar weighted means.

The per sub-pixel chroma information-generating unit 22 generates chroma information on the central sub-pixel of the three sub-pixels by reproducing chroma information Cb1, Cr1 on the target pixel onto the central sub-pixel.

Figure 26A:
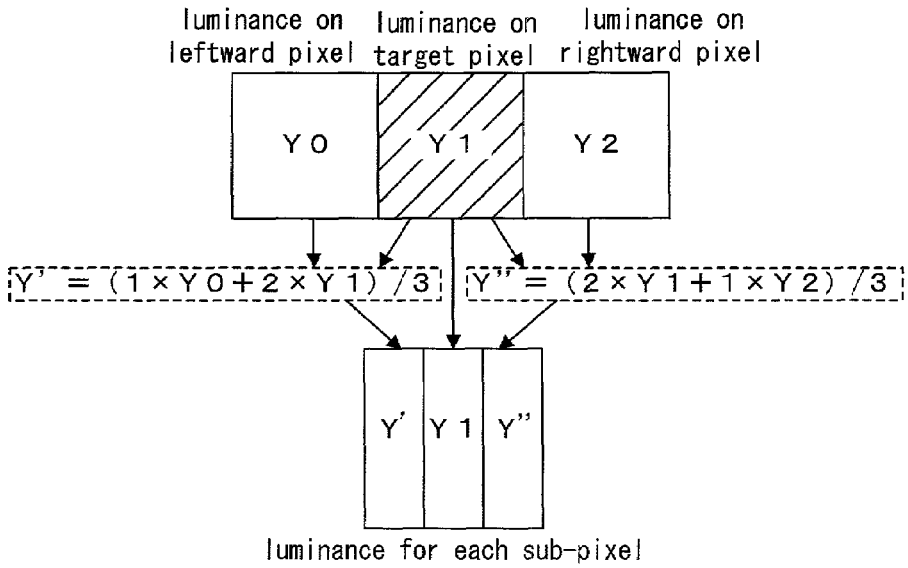
FIG. 26(*a*) is a descriptive illustration, showing how luminance information is generated using further weighted means.
Figure 26B:
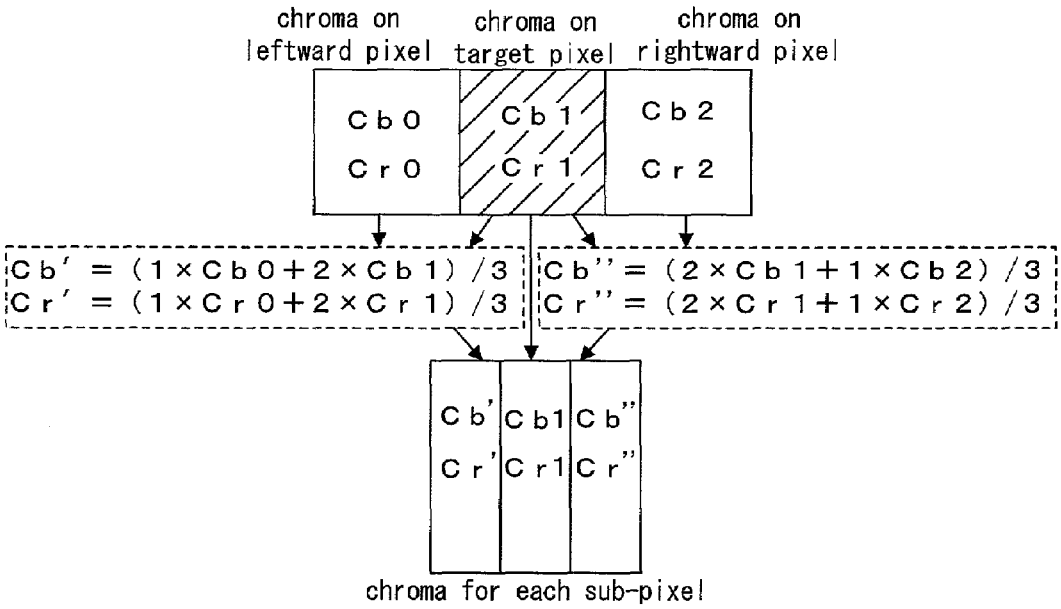

FIGS. 26(*a*) and 26(*b*) are descriptive illustrations, showing how luminance and chroma information is generated on a per sub-pixel basis using other weighted means. FIG. 26(*a*) illustrates one example of providing the luminance information, while FIG. 26(*b*) shows another example of producing the chroma information.

As illustrated in FIG. 26(*a*), the per sub-pixel luminance information-generating unit 21 generates luminance information Y' on a leftward sub-pixel of target pixel-forming three sub-pixels using a weighted means that includes luminance information Y0 on a leftward pixel next to a target pixel and luminance information Y1 on the target pixel.

More specifically, luminance information Y' is defined as $$Y'=(1*Y0+2*Y1)/3.$$

The per sub-pixel luminance information-generating unit 21 generates luminance information Y" on a rightward sub-pixel of the three sub-pixels using a similar weighted means.

The per sub-pixel luminance information-generating unit 21 provides luminance information on a central sub-pixel of the three sub-pixels by reproducing luminance information Y1 on the target pixel onto the central sub-pixel.

As shown in FIG. 26(*b*), the per sub-pixel chroma information-generating unit 22 generates chroma information Cb' on the leftward sub-pixel of the three sub-pixels using a weighted means that includes chroma information Cb0 on the leftward pixel next to the target pixel and chroma information Cb1 on the target pixel.

More specifically, chroma information Cb' is defined as $$Cb'=(1*Cb0+2*Cb1)/3.$$

The per sub-pixel chroma information-generating unit 22 generates chroma information Cr' on the leftward sub-pixel of the three sub-pixels using a weighted means that includes chroma information Cr0 on the leftward pixel next to the target pixel and chroma information Cr1 on the target pixel.

More specifically, chroma information Cr' is defined as $$Cr'=(1*Cr0+2*Cr1)/3.$$

The per sub-pixel chroma information-generating unit 22 generates chroma information Cb", Cr" on the rightward sub-pixel of the three sub-pixels using a similar weighted means.

The per sub-pixel chroma information-generating unit 22 produces chroma information on the central sub-pixel of the three sub-pixels by reproducing chroma information Cb1, Cr1 on the target pixel onto the central sub-pixel.

As discussed in connection with FIGS. 25(*a*) through 26(*b*), the use of the weighted means provides the luminance and chroma information. However, the weighted means-determining expressions are not limited to the above.

The expressions as illustrated in FIG. 10 may be used as the weighted means. However, the same pixels used to determine the luminance information on a per sub-pixel basis must be used to determine the chroma information on a per sub-pixel basis. In addition, the same weights of the weighted means used to determined the luminance information on a per sub-pixel basis must be used to determine the chroma information on a per sub-pixel basis.

A flow of processing is now described with reference to the flowchart of FIG. 27 using the display equipment illustrated in FIG. 24. Only the differences in flowcharts of FIGS. 24 and 12 are described.

Figure 27:
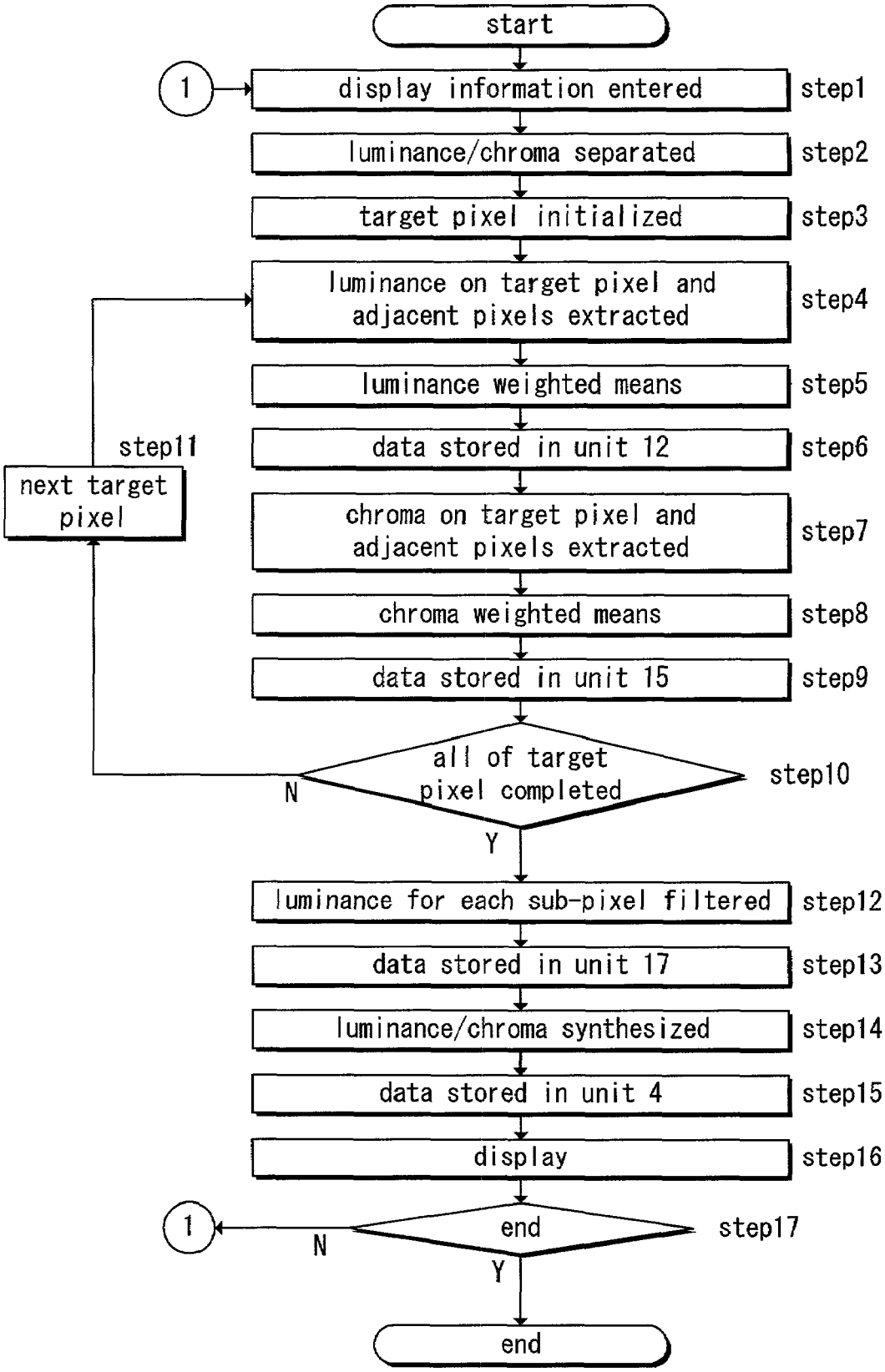
FIG. 27 is a flowchart, illustrating how display equipment behaves.
Figure 28:
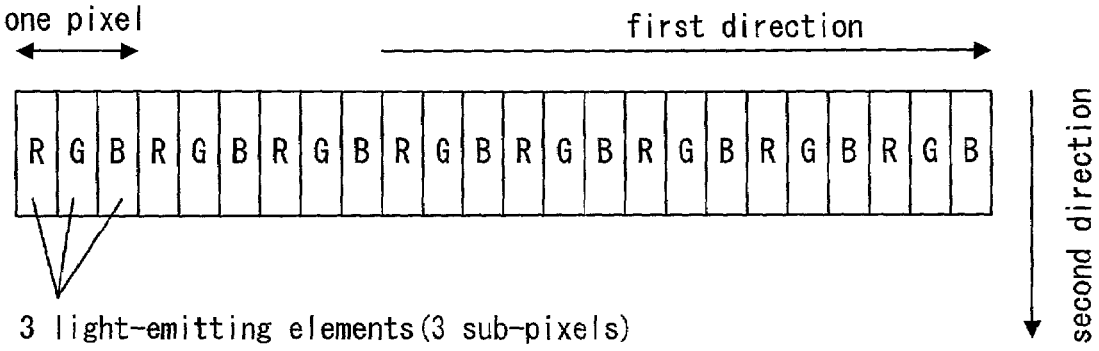
Fig. 28 PRIOR ART
FIG. 28 is a simulated illustration, showing a line as seen in the prior art.
Figure 29:
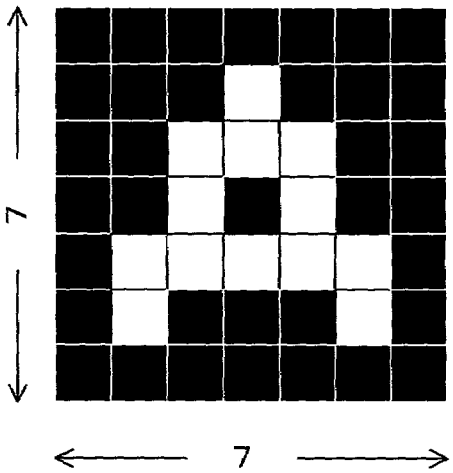
Fig. 29 PRIOR ART
FIG. 29 is an illustration, showing a prior art original image as an illustration.
Figure 30:
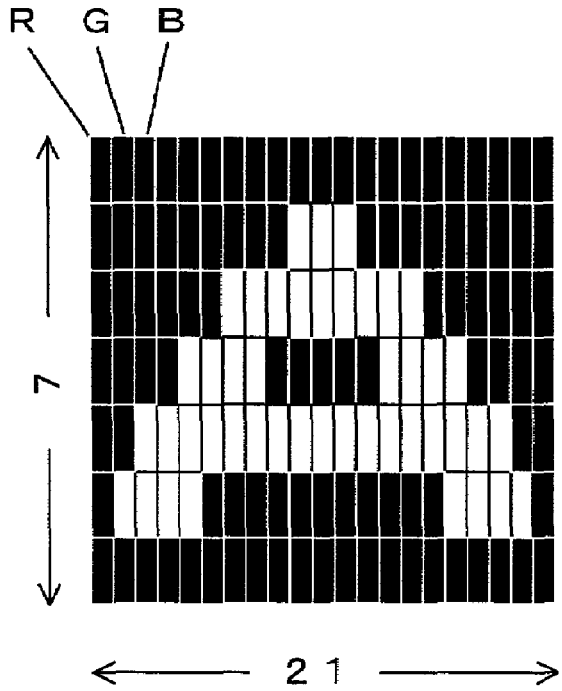
Fig. 30 PRIOR ART
FIG. 30 is an illustration, showing a prior art three-time magnified image as an illustration.
Figure 31:
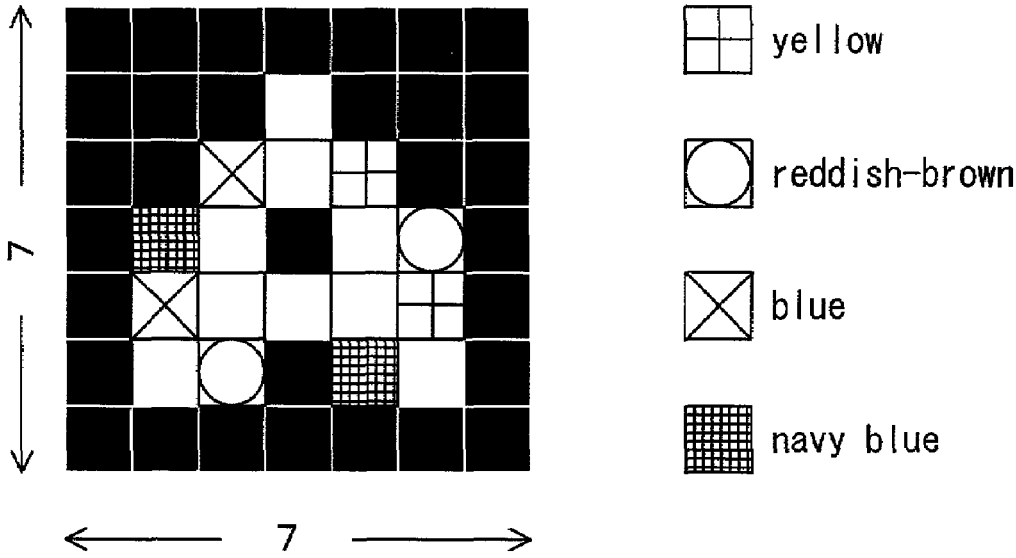
Fig. 31 PRIOR ART
FIG. 31 is a descriptive illustration, showing a color-determining process as practiced in the prior art.
Figures 32A, 32B:
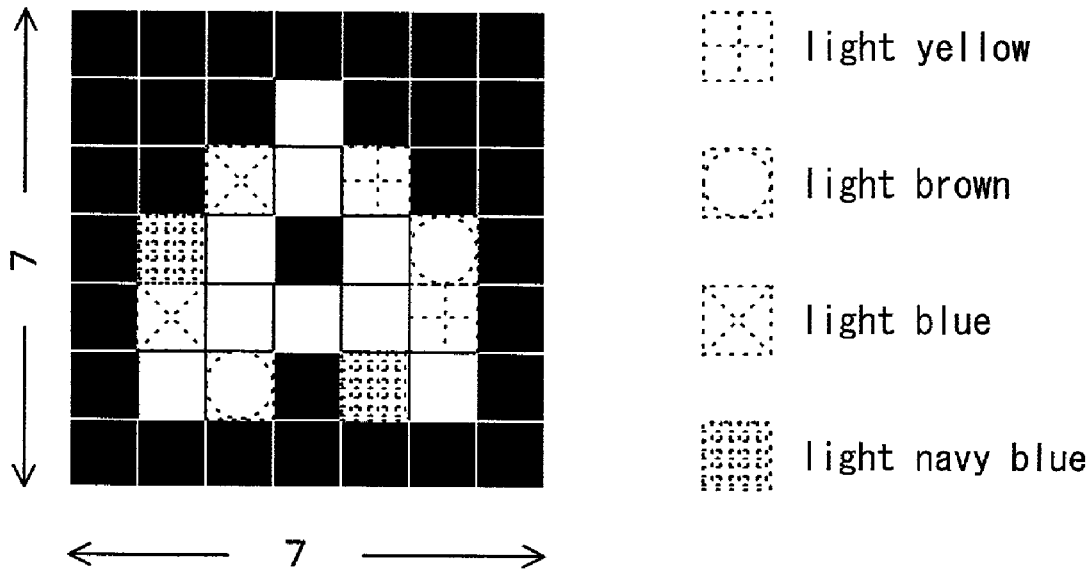
Fig. 32(a) PRIOR ART
Fig. 32(b) PRIOR ART
FIG. 32(*a*) is a descriptive illustration, showing filtering factors as employed in the prior art.

In the flowchart of FIG. 27, steps 4–9 are substituted for steps 4–10 of FIG. 12.

Steps 1–3 are similar to those of FIG. 12. The per sub-pixel luminance information-generating unit 21 extracts respective pieces of luminance information on a target pixel and neighboring pixels thereabout at step 4 from luminance information contained in the original image luminance information storage unit 7.

The per sub-pixel luminance information-generating unit 21 generates respective pieces of luminance information on two sub-pixels of target pixel forming three-pixels at opposite ends thereof at step 5 using respective weighted means that include luminance information on the target pixel and respective pieces of luminance information on contiguously adjacent pixels next to the target pixel.

The per sub-pixel luminance information-generating unit 21 produces luminance information on a central sub-pixel of the three sub-pixels by reproducing the luminance information of the target pixel onto the central sub-pixel The per sub-pixel luminance information-generating unit 21 places the luminance information generated on a per sub-pixel basis into the per sub-pixel luminance information storage unit 12 at step 6.

The per sub-pixel chroma information-generating unit 22 extracts respective pieces of chroma information on the target pixel and neighboring pixels thereabout at step 7 from chroma information contained in the original image chroma information storage unit 8.

The per sub-pixel chroma information-generating unit 22 generates respective pieces of chroma information on two sub-pixels of the target pixel-forming three sub-pixels at opposite ends thereof at step 8 using respective weighted means that include the chroma information on the target pixel and the respective pieces of chroma information on contiguously adjacent pixels next to the target pixel.

The per sub-pixel chroma information-generating unit 22 produces chroma information on the central sub-pixel of the three sub-pixels by reproducing the chroma information of the target pixel onto the central sub-pixel.

The per sub-pixel chroma information-generating unit 22 places the chroma information generated on a per sub-pixel basis into the per sub-pixel chroma information storage unit 15 at step 9. A continuous run of processing is practiced at steps 10–17.

As previously discussed, pursuant to the present embodiment, the chroma information as well as the luminance information is generated on a per sub-pixel basis. In addition, the pixels used to produce the luminance information on a per sub-pixel are used to generate the chroma information on a per sub-pixel basis. This method restrains the occurrence off-color irregularities between a multi-value image displayed on the display device 3 on per sub-pixel basis and a multi-value image (original image) entered on a pixel-by-pixel basis. This feature is similar to that of the first embodiment.

The present embodiment provides beneficial effects, which are now described in comparison with those of the first embodiment.

As illustrated in FIG. 1, the first embodiment includes the binarizing unit 9 for binarizing a target pixel and neighboring pixel thereabout to create a bitmap pattern, and the three-times magnified pattern-generating unit 10 for generating a three-times magnified pattern on the basis of the created bitmap pattern. To provide the luminance information on a per sub-pixel basis, a decision is made with reference to the three-times magnified pattern as to whether luminance information on a pixel adjacent to the target pixel is used.

Pursuant to the present embodiment, respective pieces of luminance information on predetermined sub-pixels of target pixel-forming three sub-pixels (or two sub-pixels of the three sub-pixels on opposite ends thereof) are mechanically determined on the basis of respective weighted means that include luminance information on a target pixel and respective pieces of luminance information on contiguously adjacent pixels next to the target pixel.

As a result, the present embodiment eliminates the steps of binarizing luminance information, generating a three-times magnified pattern, and referencing the three-times magnified pattern, as practiced in the first embodiment, In addition, pursuant to the present embodiment, respective pieces of chroma information on the predetermined sub-pixels of the target pixel-forming three sub-pixels (or two sub-pixels of the three sub-pixels on opposite ends thereof) are mechanically determined on the basis of respective weighted means that include chroma information on the target pixel and respective pieces of chroma information on the contiguously adjacent pixels next to the target pixel, in which the same target pixel and contiguously adjacent pixels were used to generate the luminance information.

This feature eliminates the referenced pixel information storage unit 13 according to the first embodiment, and thus obviates the steps of producing the chroma information on a per sub-pixel basis by referencing the referenced pixel information storage unit 13, as practiced in the first embodiment. As a result, the present embodiment requires less processing.

Note that the luminance and chroma information can be generated for each sub-pixel only with reference to any target pixel that is positioned at a boundary when the luminance information is binarized on a pixel-by-pixel basis.

As a result, the per sub-pixel luminance and chroma information can be contained in a limited storage area, when compared with the case in which the luminance and chroma information is generated on a per sub-pixel basis with reference to all target pixels, as illustrated in FIG. 27. In other words, the per sub-pixel luminance and chroma storage units 12 and 15 can include smaller storage capacities.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A display method comprising:

aligning three light-emitting elements with each other in certain sequence to form a pixel, said three light-emitting elements illuminating three primary colors RGB;

aligning a plurality of said pixels in a first direction to form a line;

aligning a plurality of said lines with each other in a second direction perpendicular to said first direction, thereby forming a display screen on a display device;

displaying an image on said display device;

entering per-pixel multi-value image data;

separating entered image data into per-pixel luminance information and per-pixel chroma information;

entering said per-pixel luminance information to generate a luminance pattern in accordance with per-pixel luminance information concerning pixels of a target pixel and pixels adjacent to said target pixel;

determining, among said target pixel and said pixels adjacent to said target pixel, a pixel that should be referred concerning each of target pixel-forming three sub-pixels in accordance with said generated luminance pattern;

based on said per-pixel luminance information of said determined pixel that should be referred concerning each of said target pixel-forming three sub-pixels, generating a respective pieces of luminance information on each of said target pixel-forming three sub-pixels;

based on said per-pixel chroma information of said determined pixel that should be referred concerning each of said target pixel-forming three sub-pixels, generating a respective pieces of chroma information on each of said target pixel-forming three sub-pixels; and allocating RGB values of said pixel-forming three sub-pixels to light-emitting elements that form each of said pixels; and determining said RGB values from said luminance information and chroma information on said target pixel-forming three sub-pixels, thereby displaying an image on said display device.

2. A display method comprising:

aligning three light-emitting elements with each other in certain sequence to form a pixel, said three light-emitting elements illuminating three primary colors RGB;

aligning a plurality of said pixels in a first direction to form a line;

aligning a plurality of said lines with each other in a second direction perpendicular to said first direction, thereby forming a display screen on a display device;

displaying an image on said display device;

entering per-pixel multi-value image data;

separating entered image data into per-pixel luminance information and per-pixel chroma information;

entering said per-pixel luminance information to generate a luminance pattern in accordance with per-pixel luminance information concerning pixels of a target pixel and pixels adjacent to said target pixel;

determining, among said target pixel and said pixels adjacent to said target pixel, a pixel that should be referred concerning each of target pixel-forming three sub-pixels in accordance with said generated luminance pattern;

based on said per-pixel luminance information of said determined pixel that should be referred concerning each of said target pixel-forming three sub-pixels, generating a respective pieces of luminance information on each of said target pixel-forming three sub-pixels;

based on said per-pixel chroma information of said determined pixel that should be referred concerning each of said target pixel-forming three sub-pixels, producing corrected chroma information on said target pixel; and allocating RGB values of said pixel-forming three sub-pixels to light-emitting elements that form each of said pixels;

determining said RGB values on the basis of said corrected chroma information on said target pixel and respective pieces of luminance information on said target pixel-forming three sub-pixels, thereby displaying an image on said display device.

3. A display method as defined in claim 1, wherein said determining, among said target pixel and said pixels adjacent to said target pixel, a pixel that should be referred concerning each of said target pixel-forming three sub-pixels in accordance with said generated luminance pattern includes:

determining, among said target pixel and said pixels adjacent to said target pixel, said pixel that should be referred concerning each of two sub-pixels except for a central sub-pixel of said target pixel-forming three sub-pixels; and determining said target pixel as a pixel that should be referred concerning said central sub-pixel of said target pixel-forming three sub-pixels.

4. A display method as defined in claim 1, further comprising:

comparing each of luminance values indicated by said per-pixel luminance information of said target pixel and said pixels adjacent to said target pixel with a luminance threshold value to binarize each of said luminance values, thereby generating said luminance pattern, wherein said determining, among said target pixel and said pixels adjacent to said target pixel, a pixel that should be referred concerning each of said target pixel-forming three sub-pixels in accordance with said generated luminance pattern includes:

determining, among said target pixel and said pixels adjacent to said target pixel, a pixel that should be referred concerning a sub-pixel of said target pixel-forming three sub-pixels when said sub-pixel of said target pixel-forming three sub-pixels is located at a boundary where said binarized luminance values change; and determining said target pixel as a pixel that should be referred concerning a sub-pixel of said target pixel-forming three sub-pixels when said sub-pixel of said target pixel-forming three sub-pixels is not located at a boundary where said binarized luminance values change.

5. A display method as defined in claim 2, further comprising:

comparing each of luminance values indicated by said per-pixel luminance information of said target pixel and said pixels adjacent to said target pixel with a luminance threshold value to binarize each of said luminance values, thereby generating said luminance pattern, wherein said determining, among said target pixel and said pixels adjacent to said target pixel, a pixel that should be referred concerning each of said target pixel-forming three sub-pixels in accordance with said generated luminance pattern includes:

determining, among said target pixel and said pixels adjacent to said target pixel, a pixel that should be referred concerning a sub-pixel of said target pixel-forming three sub-pixels when said sub-pixel of said target pixel-forming three sub-pixels is located at a boundary where said binarized luminance values change; and determining said target pixel as a pixel that should be referred concerning a sub-pixel of said target pixel-forming three sub-pixels when said sub-pixel of said target pixel-forming three sub-pixels is not located at a boundary where said binarized luminance values change.

6. Display equipment comprising:

a display device;

said display device including three light-emitting elements aligned with each other in certain sequence to form a pixel, said three light-emitting elements illuminating three primary colors RGB;

a plurality of said pixels aligned in a first direction to form a line;

a plurality of said lines aligned with each other in a second direction perpendicular to said first direction, thereby forming a display screen on said display device;

a luminance/chroma-separating unit operable to enter per pixel multi-value image data, thereby separating the entered multi-value image data into per-pixel luminance information and per-pixel chroma information;

a per sub-pixel luminance information-generating unit operable to enter said per-pixel luminance information to generate a luminance pattern in accordance with per-pixel luminance information concerning pixels of a target pixel and pixels adjacent to said target pixel, said per sub-pixel luminance information-generating being operable to determine, among said target pixel and said pixels adjacent to said target pixel, a pixel that should be referred concerning each of target pixel-forming three sub-pixels in accordance with said generated luminance pattern, and said per sub-pixel luminance information-generating being operable to generate, based on said per-pixel luminance information of said determined pixel that should be referred concerning each of said target pixel-forming three sub-pixels, a respective pieces of luminance information on each of said target pixel-forming three sub-pixels;

a per sub-pixel chroma information-generating unit operable to generate, based on said per-pixel chroma information of said determined pixel that should be referred concerning each of said target pixel-forming three sub-pixels, a respective pieces of chroma information on each of said target pixel-forming three sub-pixels; and a display control unit operable to allocate RGB values of said pixel-forming three sub-pixels to said light-emitting elements that form each of said pixel, and said display control unit being operable to determine said RGB values on the basis of said luminance information and chroma information on said target pixel-forming three sub-pixels, thereby displaying an image said on said display device.

7. Display equipment comprising:

a display device;

said display including three light-emitting elements aligned with each other in certain sequence to form a pixel, said three light-emitting elements illuminating three primary colors RGB;

a plurality of said pixels aligned in a first direction to form a line;

a plurality of said lines aligned with each other in a second direction perpendicular to said first direction, thereby forming a display screen on said display device;

a luminance/chroma-separating unit operable to separate multi-valued image data into per-pixel luminance information and per-pixel chroma information;

a per sub-pixel luminance information-generating unit operable to enter said per-pixel luminance information to generate a luminance pattern in accordance with per-pixel luminance information concerning pixels of a target pixel and pixel adjacent to said target pixel, said per sub-pixel luminance information-generating unit being operable to determine, among said target pixel and said pixels adjacent to said target pixel, a pixel that should be referred concerning each of target pixel-forming three sub-pixels in accordance with said generated luminance pattern, and said per sub-pixel luminance information-generating unit being operable to generate, based on said per-pixel luminance information of said determined pixel that should be referred concerning each of said target pixel-forming three sub-pixels, a respective pieces of luminance information on each of said target pixel-forming three sub-pixels;

a chroma information-correcting unit operable to produce, based on said per-pixel chroma information of said determined pixel that should be referred concerning each of said target pixel-forming three sub-pixels, corrected chroma information on said target pixel; and a display control unit operable to allocate RGB values of said pixel-forming three sub-pixels to said three light-emitting elements that form each of said pixels, and said display control unit being operable to determined said RGB values on the basis of said corrected chroma information on said target pixel and the respective pieces of luminance information on said target pixel-forming three sub-pixels, thereby displaying an image on said display device.

8. The display equipment of claim 6, wherein said per sub-pixel luminance information-generating unit determines, among said target pixel and said pixels adjacent to said target pixel, said pixel that should be referred concerning each of two sub-pixels except for a central sub-pixel of said target pixel-forming three sub-pixels, and wherein said per sub-pixel luminance information-generating unit determines said target pixel as a pixel that should be referred concerning said central sub-pixel of said target pixel-forming three sub-pixels.

9. Display equipment as defined in claim 6, wherein said per sub-pixel luminance-generating unit compares each of luminance values indicated by said per-pixel luminance information of said target pixel and said pixels adjacent to said target pixel with a luminance threshold value to binarize each of said luminance values, thereby generating said luminance pattern, wherein said per sub-pixel luminance-generating unit determines, among said target pixel and said pixels adjacent to said target pixel, a pixel that should be referred concerning a sub-pixel of said target pixel-forming three sub-pixels when said sub-pixel of said target pixel-forming three sub-pixels is located at a boundary where said binarized luminance values change, and wherein said per sub-pixel luminance-generating unit determines said target pixel as a pixel that should be referred concerning a sub-pixel of said target pixel-forming three sub-pixels when said sub-pixel of said target pixel-forming three sub-pixels is not located at a boundary where said binarized luminance values change.

10. Display equipment as defined in claim 7, wherein said per sub-pixel luminance-generating unit compares each of luminance values indicated by said per-pixel luminance information of said target pixel and said pixels adjacent to said target pixel with a luminance threshold value to binarize each of said luminance values, thereby generating said luminance pattern, wherein said per sub-pixel luminance-generating unit determines, among said target pixel and said pixels adjacent to said target pixel, a pixel that should be referred concerning a sub-pixel of said target pixel-forming three sub-pixels when said sub-pixel of said target pixel-forming three sub-pixels is located at a boundary where said binarized luminance values change, and wherein said per sub-pixel luminance-generating unit determines said target pixel as a pixel that should be referred concerning a sub-pixel of said target pixel-forming three sub-pixels when said sub-pixel of said target pixel-forming three sub-pixels is not located at a boundary where said binarized luminance values change.

* * * * *

UNITED STATES PATENT AND TRADEMARK OFFICE

CERTIFICATE OF CORRECTION

PATENT NO. : 7,102,655 B2 
APPLICATION NO. : 10/156707
DATED : September 5, 2006
INVENTOR(S) : Bunpei Toji et al.

It is certified that error appears in the above-identified patent and that said Letters Patent is hereby corrected as shown below:

Column 2, Line 10, Delete "ae" and insert -- are --.

Column 2, Line 24, After "OF" insert -- THE --.

Column 3, Line 22, Delete "information generating" and insert -- information-generating --.

Column 3, Line 62, Delete "pixel-forning" and insert -- pixel-forming --.

Column 4, Line 4, Delete "pixel-forning" and insert -- pixel-forming --.

Column 5, Line 25, Delete "sub pixels" and insert --sub-pixels --.

Column 8, Line 65, Delete "unit I" and insert -- unit 1 --.

Column 9, Line 18, Delete "invented" and insert -- invented. --.

Column 9, Line 20, Delete "brief" and insert -- brief. --.

Column 9, Line 35 (Approx.) Delete "Cb=0.172*r-" and insert -- Cb=-0.172*r--.

Column 14, Line 6, Delete "sub pixels" and insert --sub-pixels --.

Column 14, Line 6, Delete "sub pixels" and insert --sub-pixels --.

Column 14, Line 60, Delete "1" and insert --11 --.

Column 17, Line 56, Delete "49.9." and insert -- -49.9. --.

Column 18, Line 48 (Approx.) Delete "$Y = 0.299 * r + 0.587 * g + 0.114 * b$," and insert -- Y=0.299*r+0.587*g+0.114*b, --.

Column 18, Line 49 (Approx.) Delete "$\underline{Cb = -0.172 * r - 0.339 * g + 0.511 * b, \text{ and}}$" and insert -- Cb=-0.172*r-0.339*g+0.511*b, and --.

UNITED STATES PATENT AND TRADEMARK OFFICE

CERTIFICATE OF CORRECTION

PATENT NO. : 7,102,655 B2
APPLICATION NO. : 10/156707
DATED : September 5, 2006
INVENTOR(S) : Bunpei Toji et al.

It is certified that error appears in the above-identified patent and that said Letters Patent is hereby corrected as shown below:

Column 18, Line 50 (Approx.) Delete "$Cr = 0.511 * r - 0.428 * g - 0.083 * b$," and insert -- Cr=0.511*r-0.428*g-0.083*b, --.

Column 18, Line 59, Delete "$r = Y + 1.371 * Cr$;" and insert -- r=Y+1.371*Cr; --.

Column 18, Line 60, Delete "$g = Y - 0.698 * Cr + 0.336 * Cb$; and" and insert -- g=Y-0.698*Cr+0.336*Cb; and, --.

Column 18, Line 61, Delete "$b = Y + 1.732 * Cb$," and insert -- b=Y+1.732*Cb, --.

Column 19, Line 14, Delete "$R = Y1 + 1.371 * Crl$;" and insert -- R=Y1+1.371*Crl; --.

Column 19, Line 15, Delete "$G = Y2 - 0.698 * Cr2 + 0.336 * Cb2$;" and insert -- G=Y2-0.698*Cr2+0.336*Cb2; --.

Column 19, Line 16, Delete "$B = Y3 + 1.732 * Cb3$." and insert -- B=Y3+1.732*Cb3. --.

Column 20, Line 46, Delete "ROB" and insert -- RGB --.

Column 20, Line 57, Delete "ROB" and insert -- RGB --.

Column 22, Line 65, Delete "FIG. 18 i(c)," and insert -- FIG, 18(c), --.

Column 24, Line 39, After "expressions" insert -- : --.

Column 24, Line 43, Delete "respectively," and insert -- respectively. --.

Column 25, Line 37, After "step 9" insert -- ( --.

Column 26, Line 50, After "embodiment" insert -- . --.

Column 29, Line 27, Delete "pixel forming" and insert -- pixel-forming --.

Column 29, Line 35 After "sub-pixel" insert -- . --.

Column 29, Line 67, Delete "off-color" and insert -- of color --.

UNITED STATES PATENT AND TRADEMARK OFFICE

CERTIFICATE OF CORRECTION

PATENT NO. : 7,102,655 B2
APPLICATION NO. : 10/156707
DATED : September 5, 2006
INVENTOR(S) : Bunpei Toji et al.

It is certified that error appears in the above-identified patent and that said Letters Patent is hereby corrected as shown below:

Column 30, Line 30, Delete “embodiment,” and insert -- embodiment. --.

Column 33, Line 30-31, In Claim 6, delete “per pixel” and insert -- per-pixel --.

Signed and Sealed this

Thirtieth Day of January, 2007

JON W. DUDAS
*Director of the United States Patent and Trademark Office*